US005427901A

United States Patent [19]

Arakatsu et al.

[11] Patent Number: 5,427,901

[45] Date of Patent: Jun. 27, 1995

[54] HEAT-DEVELOPABLE COLOR LIGHT-SENSITIVE MATERIAL

[75] Inventors: Hiroshi Arakatsu; Yoshio Inagaki; Hiroyuki Ozaki; Takanori Hioki, all of Kanagawa, Japan

[73] Assignee: Fuji Photo Film Co., Ltd., Kanagawa, Japan

[21] Appl. No.: 176,695

[22] Filed: Jan. 3, 1994

Related U.S. Application Data

[63] Continuation of Ser. No. 684,734, Apr. 15, 1991, abandoned.

[30] Foreign Application Priority Data

Apr. 16, 1990 [JP] Japan ..... 2-100102
May 28, 1990 [JP] Japan ..... 2-137885

[51] Int. Cl.[6] ..... G03C 1/00

[52] U.S. Cl. ..... 430/505; 430/203; 430/359; 430/508; 430/581; 430/584; 430/585; 430/592; 430/620; 430/944; 430/958

[58] Field of Search ..... 430/203, 508, 515, 944, 430/585, 584, 592, 620, 581, 958, 359

[56] References Cited

U.S. PATENT DOCUMENTS

| | | | |
|---|---|---|---|
| 2,265,547 | 12/1941 | Schneider | 430/357 |
| 3,988,513 | 10/1976 | Matsuyama et al. . | |
| 4,536,473 | 8/1985 | Mihara | 430/944 |
| 4,619,892 | 10/1986 | Simpson et al. | 430/944 |
| 4,677,051 | 6/1987 | Kubodera et al. . | |
| 4,690,883 | 9/1987 | Kubodera et al. | 430/584 |
| 4,690,893 | 9/1987 | Kubodera et al. | 430/584 |
| 4,713,316 | 12/1987 | Kubodera et al. | 430/584 |
| 4,717,650 | 1/1988 | Ikeda et al. | 430/584 |
| 4,873,184 | 10/1989 | Simpson . | |
| 4,978,606 | 12/1990 | Ohki et al. | 430/505 |
| 5,079,132 | 1/1992 | Mitsui et al. | 430/359 |
| 5,108,872 | 4/1992 | Inoue et al. | 430/944 |
| 5,154,995 | 10/1992 | Kawai et al. | 430/944 |

OTHER PUBLICATIONS

Research Disclosure, No. 299, Mar. 1989, Havant GB, pp. 208–214; P. W. Lauf; "Photothermographic Silver Halide Systems".

*Primary Examiner*—Thorl Chea
*Attorney, Agent, or Firm*—Sughrue, Mion, Zinn, Macpeak & Seas

[57] ABSTRACT

A heat-developable color light-sensitive material comprising a support having thereon at least three silver halide emulsion layers each sensitive to a different spectral wavelength region, one silver halide emulsion layer or a light-insensitive layer adjacent thereto containing a yellow dye-providing compound, a second silver halide emulsion layer or a light-insensitive layer adjacent thereto containing a magenta dye-providing compound and a third silver halide emulsion layer or a light-insensitive layer adjacent thereto containing a cyan dye-providing compound; at least one of said silver halide emulsion layers having a maximum spectral sensitivity at a wavelength of at least 700 nm and a spectral sensitivity at a wavelength 20 nm longer than said maximum spectral sensitivity wavelength of at most 1/10 of said maximum spectral sensitivity.

A heat-developable color light-sensitive material with such spectral sensitivity characteristics in at least one silver halide emulsion layer provides superior color separation from other layers having a sensitivity in the infrared region.

13 Claims, No Drawings

HEAT-DEVELOPABLE COLOR LIGHT-SENSITIVE MATERIAL

This is a Continuation of Application Ser. No. 07/684,734, filed Apr. 15, 1991, now abandoned.

FIELD OF THE INVENTION

The present invention relates to a heat-developable color light-sensitive material capable of providing images excellent in color separation upon exposure in the region of from near infrared to infrared.

BACKGROUND OF THE INVENTION

Since a photographic process using silver halide is excellent as compared to other photographic processes such as an electrophotographic process and a diazophotographic process in photographic characteristics such as light sensitivity and gradation control, the former process is most widely used. Recently, a technique capable of more simply and quickly obtaining images has been developed, in which the image-forming process for a silver halide photographic light-sensitive material is changed from conventional wet processing to dry processing using heating.

A heat-developable light-sensitive material is known in the field of the art and heat-developable light-sensitive materials and processes of development using them are described, e.g., in *Shashin Kogaku no Kiso* (*Foundation of Photographic Engineering*, pages 553 to 555 (published by Corona K. K., 1979), *Eizoo Jooho (Image Information)*, page 40, published April 1978, Nebletts, *Handbook of Photography and Reprography*, 7th Ed., pages 32 and 33, published by Van Nostrand Reinhold Company, U.S. Pat. Nos. 3,152,904, 3,301,678, 3,392,020, and 3,457,075, British Patents 1,131,108, 1,167,777, and *Research Disclosure*, (RD-17029), pages 9 to 15, June, 1978.

Also, various processes of obtaining color images by heating are proposed, e.g., in *Research Disclosure*, (RD-16966), pages 54 to 58, May, 1978, ibid., (RD-14433), pages 30 to 32, April, 1976, U.S. Pat. Nos. 3,985,655, 4,463,079, 4,474,867, 4,478,927, 4,507,380, 4,500,626, and 4,483,914.

In these methods, imagewise distributions of dyes are formed by forming or releasing the dyes by heating and the imagewise distributions of dyes are obtained in a short period of time.

However, in conventionally used sensitizing dyes for the regions of from near infrared to infrared, the reduction of the color sensitivity from the wavelength at the maximum spectral sensitivity to the long wave side is not sharp. When a light-sensitive material has a layer having a spectral sensitivity in the region of a longer wavelength than the above described light-sensitive layer together with the light-sensitive layer, there is a problem that the color separation of the layer from the light-sensitive layer is insufficient.

SUMMARY OF THE INVENTION

An object of the present invention is to provide a heat-developable color light-sensitive material having excellent color separation in the region from near infrared to infrared.

It has now been discovered that this and other objects of the present invention have been achieved by a heat-developable color light-sensitive material comprising a support having thereon at least three silver halide emulsion layers each sensitive to a different spectral wavelength region, one silver halide emulsion layer or a light-insensitive layer adjacent thereto containing a yellow dye-providing compound, a second silver halide emulsion layer or a light-insensitive layer adjacent thereto containing a magenta dye-providing compound and a third silver halide emulsion layer or a light-insensitive layer adjacent thereto containing a cyan dye-providing compound; at least one of said silver halide emulsion layers having a maximum spectral sensitivity at a wavelength of at least 700 nm and a spectral sensitivity at a wavelength 20 nm longer than said maximum spectral sensitivity of at most 1/10 of said maximum spectral sensitivity.

DETAILED DESCRIPTION OF THE INVENTION

In one embodiment of the present invention, by spectrally sensitizing a silver halide emulsion using a dicarboimidacyanine dye, the spectral sensitivity thereof to light of a wavelength of 20 nm wavelength longer than the maximum spectral sensitivity wavelength is not more than 1/10 of the maximum spectral sensitivity.

As the dicarboimidacyanine dye, the compound represented by formula (I) is preferred:

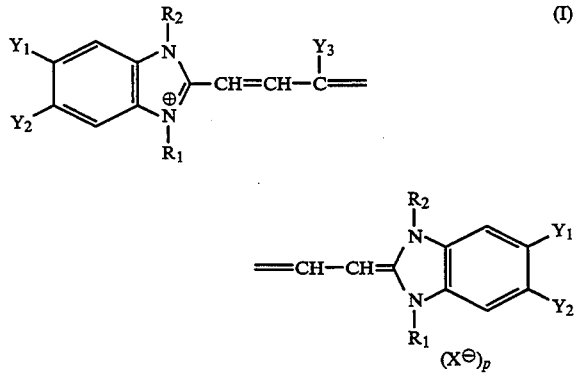

(I)

wherein $R_1$ and $R_2$, which may be the same or different, each represents an alkyl group having from 1 to 8 carbon atoms; $Y_1$ and $Y_2$, which may be the same or different, each represents an atomic group necessary for completing a benzene nucleus when $Y_1$ and $Y_2$ are linked, or each represents hydrogen, a halogen atom, a cyano group, or a perfluoroalkyl group; $Y_3$ represents hydrogen, an alkyl group having from 1 to 4 carbon atoms, a benzyl group, or a phenyl group; X represents an anion; and p represents a number of X groups required for charge balance, provided that X may be linked with $R_1$ or $R_2$ to form an intramolecular salt.

The compounds represented by formula (I) can be synthesized by the method described in U.S. Pat. No. 4,717,650.

The compounds represented by formula (I) are now described in greater detail.

The alkyl group represented by $R_1$ or $R_2$ includes straight chain, branched, and cyclic alkyl groups which may be substituted by a substituent such as a halogen atom, an alkoxy group, an alkylthio group, a sulfonic acid group or its salt, and a carboxy group or the salt thereof.

$R_1$ is particularly preferably an alkyl group having from 1 to 4 carbon atoms, including an unsubstituted alkyl group and an alkyl group substituted by a sulfonic acid group or a salt thereof.

$R_2$ is particularly preferably an alkyl group having from 1 to 4 carbon atoms, and an unsubstituted alkyl group and an alkyl group substituted by a halogen atom or an alkoxy group having from 1 to 4 carbon atoms are preferred.

$Y_1$ and $Y_2$ are preferably hydrogen, chlorine, a cyano group or a trifluoromethyl group and, in particular, it it preferred that $Y_1$ is chlorine and $Y_2$ is chlorine, a cyano group, or a trifluoromethyl group.

$Y_3$ is preferably hydrogen, a methyl group, an ethyl group, or a butyl group and is particularly preferably hydrogen.

Preferred anions represented by X include a halide ion, a sulfonate ion, and a carbonate ion, and in particular, an iodide ion, a p-toluenesulfonate ion, an acetate ion, and a sulfonate ion substituted on $R_1$ are preferred. In these cases, p is 1.

U.S. Pat. No. 4,717,650 deals with photographic materials containing dyes of formula (I).

Specific examples of the dicarboimidacyanine dye in the present invention are illustrated below, but the present invention is not to be construed as being limited to them.

A-1

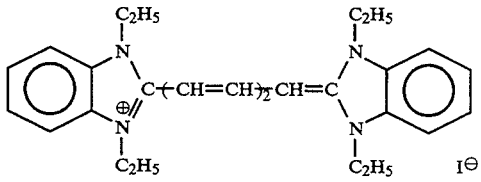

A-2

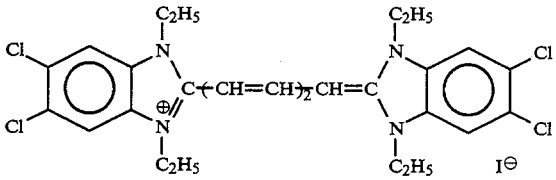

A-3

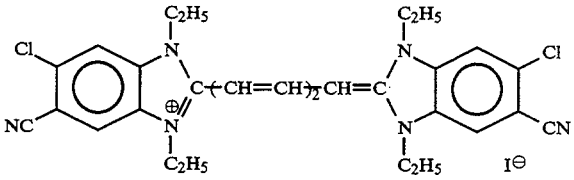

A-4

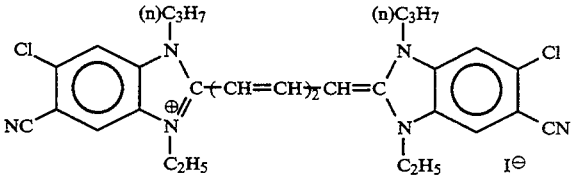

A-5

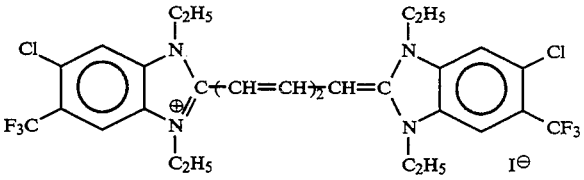

A-6

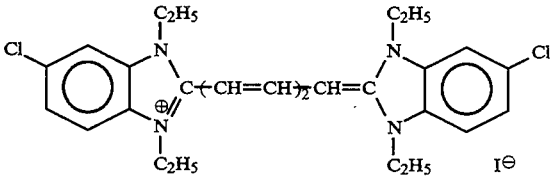

A-7

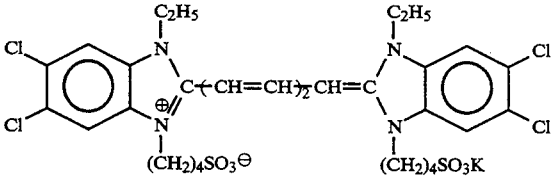

-continued
A-8
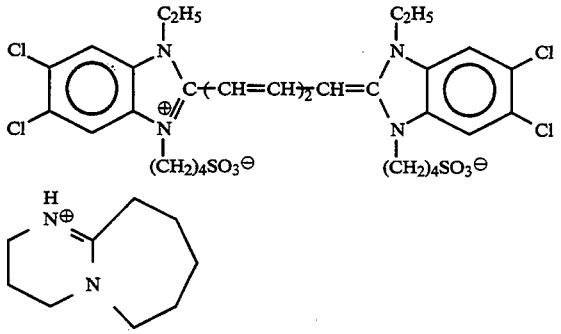
A-9
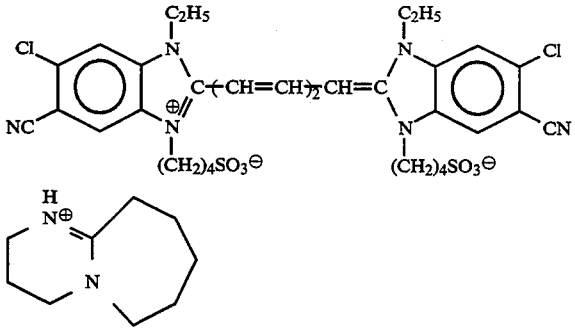
A-10
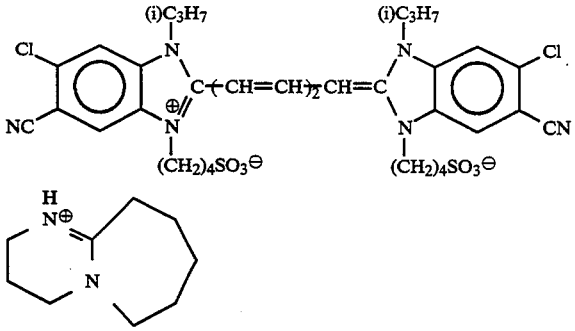
A-11
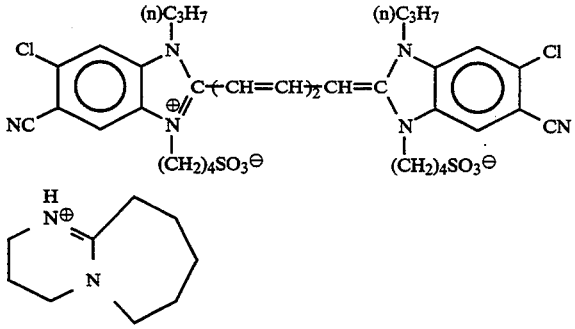
A-12
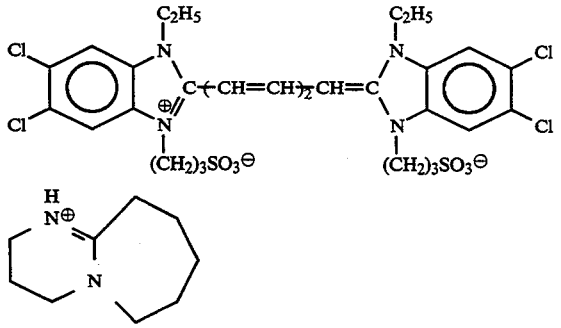

-continued
A-13
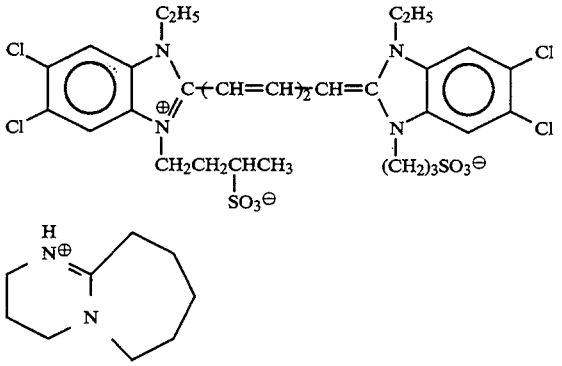
A-14
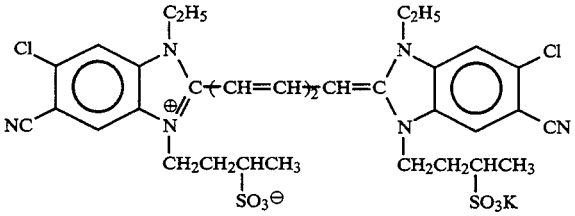
A-15
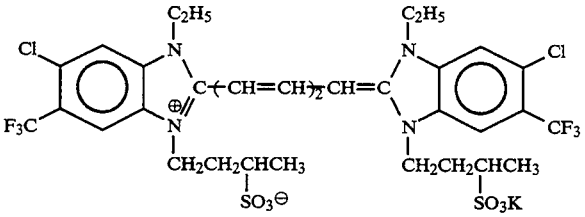
A-16
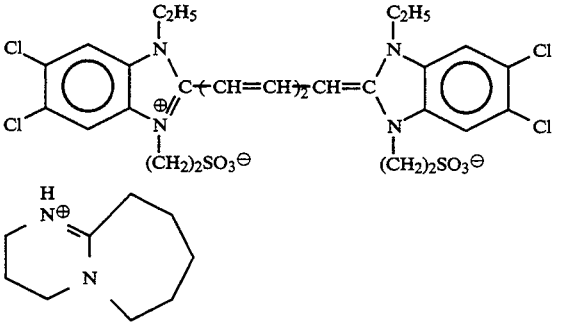
A-17
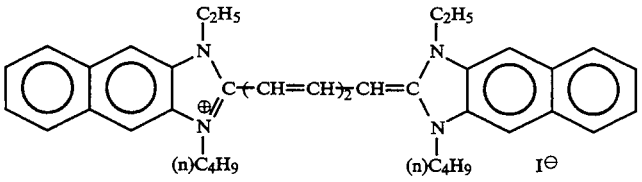
A-18
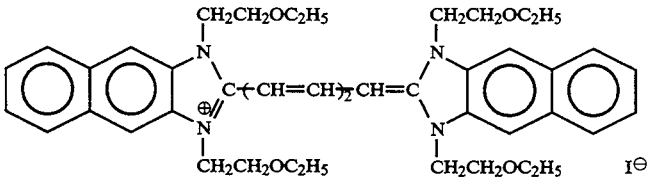
A-19
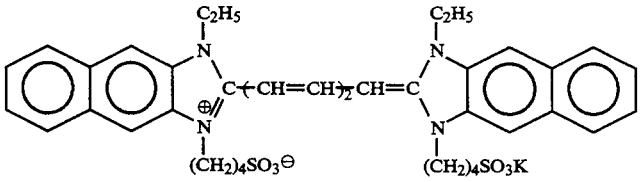

-continued

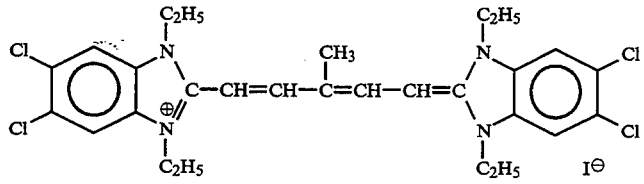

A-20

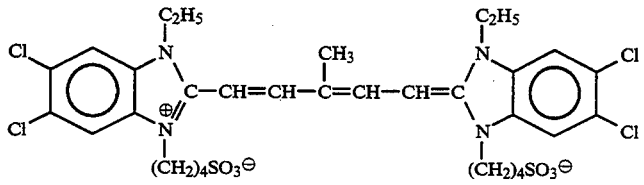

A-21

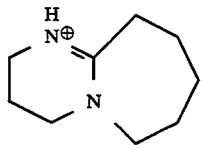

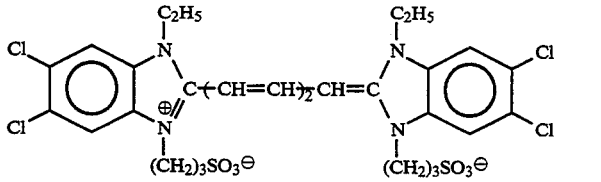

A-22

The sensitizing dyes for use in the present invention may be used singly or as a combination thereof and a combination of sensitizing dyes is frequently used for the purpose of super color sensitization.

The silver halide emulsion in the present invention may contain, together with the sensitizing dye(s), a dye having no spectral sensitizing action by itself or a compound which does not substantially absorb visible light but exhibits a supersensitization effect (described, e.g., in U.S. Pat. No. 3,615,641 and JP-A-63-23145 (the term "JP-A" as used herein refers to a "published unexamined Japanese patent application")).

The sensitizing dye for use in the present invention may be added to a silver halide emulsion during the formation of the silver halide grains, before, during or after chemical ripening of the emulsion, or during the preparation of the coating composition of the emulsion, but it is preferred to add the sensitizing dye to the silver halide emulsion during the formation of the silver halide grains or before, during or after chemical ripening of the emulsion.

The temperature at the addition of the sensitizing dye may be at least 30° C., and is preferably at least 50° C., and it is preferred to provide an adsorption time of the sensitizing dye of 15 minutes or more. It is more preferred to add the sensitizing dye to the emulsion at a temperature of at least 60° C. and to provide an adsorption time of the sensitizing dye of 30 minutes or more.

The addition amount of the sensitizing dye for use in the present invention is generally from about $1\times10^{-8}$ to $1\times10^{-2}$ mol per mol of silver halide.

In the present invention, in combination with the silver halide emulsion spectrally sensitized with the above described sensitizing dye(s), silver halide emulsions spectrally sensitized with other sensitizing dye(s) are used. The other sensitizing dye which is used includes cyanine dyes, merocyanine dyes, complex cyanine dyes, complex merocyanine dyes, holopolar cyanine dyes, hemicyanine dyes, styryl dyes, and hemioxonol dyes which are known in the field of the art.

Practical examples of these sensitizing dyes are described in U.S. Pat. No. 4,617,259, JP-A-59-180550, JP-A-60-140335, and *Research Disclosure*, No. 17029, pages 12 and 13 (1978).

In a second embodiment of the present invention, a heat-developable color light-sensitive material comprises a support having thereon at least three silver halide emulsion layers each sensitive to a different spectral wavelength region, one silver halide emulsion layer or a light-insensitive layer adjacent thereto containing a yellow dye-providing compound, a second silver halide emulsion layer or a light-insensitive layer adjacent thereto containing a magenta dye-providing compound and a third silver halide emulsion layer or a light-insensitive layer adjacent thereto containing a cyan dye-providing compound; at least one of said silver halide emulsion layers having a maximum spectral sensitivity at a wavelength of at least 790 nm and a sensitivity difference of at least 0.6 logE between said maximum spectral sensitivity and the spectral sensitivity of said emulsion at a wavelength 60 nm shorter than said maximum spectral sensitivity wavelength.

The spectral sensitivity characteristics described above can be obtained by spectrally sensitizing the silver halide emulsion with a sensitizing dye represented by formula (II):

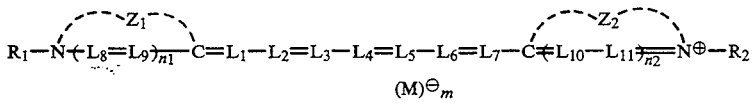

(II)

wherein $Z_1$ and $Z_2$, which may be the same or different, each represents an atomic group necessary for forming a 5- or 6-membered nitrogen-containing heterocyclic ring; $L_1$, $L_2$, $L_3$, $L_4$, $L_5$, $L_6$, $L_7$, $L_8$, $L_9$, $L_{10}$, and $L_{11}$, which may be the same or different, each represents a methine group or a substituted methine group, either of $L_2$ and $L_4$ or $L_3$ and $L_5$ link to form a 5-, 6-, or 7-membered ring; $R_1$ and $R_2$, which may be the same or different, each represents an alkyl group; $n_1$ and $n_2$ each represents 0 or 1; M represents a counter ion; and m represents the number of M groups necessary for charge balance.

U.S. Pat. No. 4,536,473 deals with photographic materials containing dyes of formula (II).

The sensitizing dyes represented by formula (II) are now described in detail.

$R_1$ and $R_2$ each preferably represents an unsubstituted alkyl group having not more than 18 carbon atoms (e.g., methyl, ethyl, propyl, butyl, pentyl, octyl, decyl, dodecyl, and octadecyl) or a substituted alkyl group. Examples of the substituent include a carboxyl group, a sulfo group, a cyano group, a halogen (e.g., fluorine, chlorine, and bromine), a hydroxyl group, an alkoxycarbonyl group having not more than 8 carbon atoms (e.g., methoxycarbonyl, ethoxycarbonyl, phenoxycarbonyl, and benzyloxycarbonyl), an alkoxy group having not more than 8 carbon atoms (e.g., methoxy, ethoxy, benzyloxy, and phenethyloxy), a monocyclic or dicyclic aryloxy group having not more than 18 carbon atoms (e.g., phenoxy, p-tolyloxy, 1-naphthoxy, and 2-naphthoxy), an acyloxy group having not more than 3 carbon atoms (e.g., acetyloxy and propionyloxy), an acyl group having not more than 8 carbon atoms (e.g., acetyl, propionyl, benzoyl, and mesyl), a carbamoyl group (e.g., carbamoyl, N,N-dimethylcarbamoyl, morpholinocarbonyl, and piperidinocarbonyl), a sulfamoyl group (e.g., sulfamoyl, N,N-dimethylsulfamoyl, morpholinosulfonyl, and piperidinosulfonyl), an aryl group having not more than 10 carbon atoms (e.g., phenyl, 4-chlorophenyl, 4-methylphenyl, and naphthyl), and an alkylthio group having not more than 10 carbon atoms (e.g., methylthio, 2-(methylthio)ethylthio and 2-(hydroxyethylthio)ethylthio).

$R_1$ and $R_2$ each more preferably represents an unsubstituted alkyl group (e.g., methyl, ethyl, n-propyl, n-butyl, n-pentyl, and n-hexyl), a carboxyalkyl group (e.g., 2-carboxyethyl and carboxymethyl), a sulfoalkyl group (e.g., 2-sulfoethyl, 3-sulfopropyl, 4-sulfobutyl, and 3-sulfobutyl), an aryloxy-substituted alkyl group (e.g., 2-(1-naphthoxyethyl), 2-(phenoxypropyl), and 3-(1-naphthoxypropyl)), a sulfido group-substituted alkyl group (e.g., 2-methylthioethyl, 2-(2-methylthioethylthio)ethyl, 2-(2-hydroxyethylthio)ethyl, and 3-(2-methylthioethylthio)ethyl).

The ring formed by $L_2$ and $L_4$ or by $L_3$ and $L_5$ preferably represents an atomic group forming a 5- or 6-membered ring, which preferably has an oxygen or a nitrogen in the ring.

Particularly preferred rings formed by $L_2$ and $L_4$ or by $L_3$ and $L_5$ are represented by the following formulae:

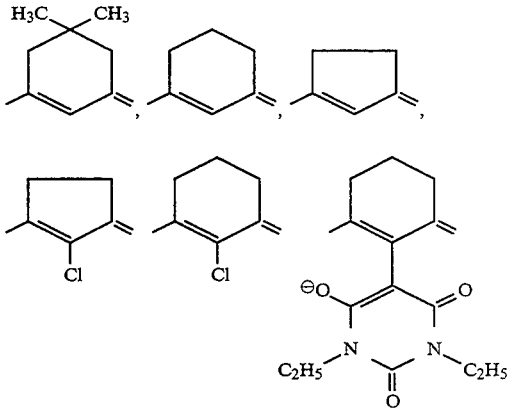

M and m in formula (II) represent cations or anions when these ions are necessary for neutralizing the ionic charges of the dye. Whether a dye is a cation or an anion, or whether a dye has ionic charges depends upon the auxochrome and the substituent(s) thereof.

Typical cations are inorganic or organic ammonium ions and alkali metal ions. The anions may be inorganic anions or organic anions and examples thereof include halide anions (e.g., fluoride, chloride, bromide, and iodide), substituted arylsulfonate ions (e.g., p-toluenesulfonate ions and p-chlorobenzenesulfonate ions), aryldisulfonate ions (e.g., 1,3-benzenedisulfonate ions, 1,5-naphthalenedisulfonate ions, and 2,6-naphthalenedisulfonate ions), alkylsulfate ions (e.g., methylsulfate ions), sulfate ions, thiocyanate ions, perchlorate ions, tetrafluoroborate ions, picrate ions, acetate ions, and trifluoromethanesulfate ions.

Of these anions, ammonium ions, iodide ions, and p-toluenesulfonate ions are preferred.

The nucleus formed by $Z_1$ and $Z_2$ includes thiazole nuclei (e.g., azole, 4-methylthiazole, 4-phenylthiazole, 4,5-dimethylthiazole, and 4,5-diphenylthiazole), benzothiazole nuclei (e.g., benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydrobenzothiazole, and 4-phenylbenzothiazole), naphthothiazole nuclei (e.g., naphtho[2,1-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole), thiazoline nuclei (e.g., thiazoline, 4-methylthiazoline, and 4-nitrothiazoline), oxazole nuclei (such as oxazole nuclei (e.g., oxazole, 4-methyloxazole, 4-nitroxazole, 5-methyloxazole, 4-phenyloxazole, 4,5-diphenyloxazole, and 4-ethyloxazole), benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzoxazole ), naphthoxazole nuclei (e.g., naphth[2,1-d]oxazole, naphtho[1,2-d]oxazole, and 5-nitronaphth[2,1-d]oxazole)), oxazoline nuclei (e.g., 4,4-dimethyloxazoline), selenazole nuclei (e.g., 4-methylselenazole, 4-nitroselenazole, and 4-phenylselenazole), benzoselenazole nuclei (e.g., benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole, and 5,6-dimethylbenzoselenazole), naphthoselenazole nuclei (e.g., naphtho[2,1-d)selenazole and naphtho[1,2-d]selenazole), selenazoline nuclei (e.g., selenazoline and 4-methylselenazoline), tellurazole nuclei (tellurazole nuclei (e.g., tellurazole, 4-methyltellurazole, and 4-phenyltellurazole), benzotellurazole nuclei (e.g., benzotellurazole, 5-chlorobenzotellurazole, 5-methylbenzotellurazole, 5,6-dimethylbenzotellurazole, and 6-methoxybenzotellurazole), naphthotellurazole nuclei (e.g., naphtho[2,1-d]tellurazole, and naphtho[1,2-d]tellurazole)), tellurazoline nuclei (e.g., tellurazoline and 4-methyltellurazoline), 3,3-dialkylindolenine nuclei (e.g., 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine), imidazole nuclei (imidazole nuclei (e.g., 1-alkylimidazole, 1-alkyl-4-phenylimidazole, and 1-arylimidazole), benzimidazole nuclei (e.g., 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, and 1-aryl-5-cyanobenzimidazole), naphthimidazole nuclei (e.g., 1-alkylnaphth[1,2-d]imidazole and 1-arylnaphth[1,2-d]imidazole)), pyridine nuclei (e.g., 2-pyridine, 4-pyridine, 5-methyl-2-pyridine, and 3-methyl-4-pyridine), quinoline nuclei (such as quinoline nuclei (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline), isoquinoline nuclei (e.g., 6-nitro-1-isoquinoline, 3,4-dihydro-1-isoquinoline, and 6-nitro-3-isoquinoline)), imidazo[4,5-b]quinoxaline nuclei (e.g., 1,3-diethylimidazo[4,5-b]quinoxaline and 6-chloro-1,3-diallylimidazo[4,5-b]quinoxaline), oxadiazole nuclei, thiadiazole nuclei, tetrazole nuclei, and pyrimidine nuclei.

As the nucleus formed by $Z_1$ and $Z_2$, naphthothiazole nuclei, benzoxazole nuclei, naphthoxazole nuclei, and benzimidazole nuclei are preferred, and benzothiazole nuclei are particularly preferred.

In the imidazole nuclei, the alkyl group has from 1 to 8 carbon atoms, and is preferably an unsubstituted alkyl group such as methyl, ethyl, propyl, isopropyl or butyl, or a hydroxylalkyl group (e.g., 2-hydroxyethyl and 3-hydroxypropyl), and is particularly preferably methyl and ethyl; and the aryl group is phenyl, phenyl substituted by a halogen (e.g., chlorine), phenyl substituted by an alkyl (e.g., methyl), or phenyl substituted by an alkoxy (e.g., methoxy).

$L_1$, $L_2$, $L_3$, $L_4$, $L_5$, $L_6$, $L_7$, $L_8$, $L_9$, $L_{10}$, and $L_{11}$ each represents a methine group or a methine group substituted by a substituent such as, for example, a substituted or unsubstituted alkyl group (e.g., methyl, ethyl, and 2-carboxyethyl), a substituted or unsubstituted aryl group (e.g., phenyl and o-carboxyphenyl), a heterocyclic group (e.g., barbituric acid), a halogen atom (e.g., chlorine and bromine), an alkoxy group (e.g., methoxy and ethoxy), an amino group (e.g., N,N-diphenylamino, N-methyl-N-phenylamino, and N-methylpiperidino), or an alkylthio group (e.g., methylthio and ethylthio).

Specific examples of the dye represented by formula (II) are illustrated below, but the present invention is not to be construed as being limited to these dyes.

(II)-(a)
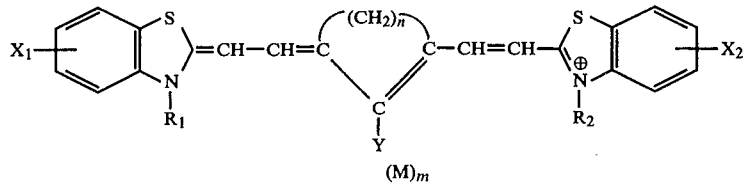
| Compound No. | $R_1$ | $R_2$ | $X_1$ | $X_2$ | Y | n | M | m |
|---|---|---|---|---|---|---|---|---|
| B-1 | $C_2H_5$ | $C_2H_5$ | H | H | H | 2 | $I^{\ominus}$ | 1 |
| B-2 | " | " | " | " | 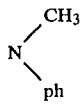 | 2 | " | 1 |
| B-3 | " | " | " | " | Cl | 3 | " | 1 |
| B-4 | $CH_2CO_2H$ | " | " | " | N-$ph_2$ | 2 | $Br^{\ominus}$ | 1 |
| B-5 | $(CH_2)_3SO_3^{\ominus}$ | " | " | " | H | 2 | $Cl^{\ominus}$ | 1 |
| B-6 | $(CH_2)_4CH_3$ | " | 6-$CH_3$ | " | " | 3 | 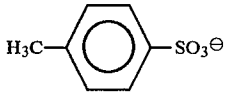 | 1 |
| B-7 | $(CH_2)_4SO_3^{\ominus}$ | $(CH_2)_4SO_3^{\ominus}$ | H | " | $OCH_3$ | 3 | $HN(C_2H_5)_3^{\ominus}$ | 1 |
| B-8 | $CH_3$ | $C_2H_5$ | 6,7-benzo | 5-$CH_3$ | $CH_3$ | 4 | $I^{\ominus}$ | 1 |
| B-9 | 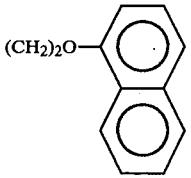 | $C_2H_5$ | H | H | H | 3 | $I^{\ominus}$ | 1 |
| B-10 | 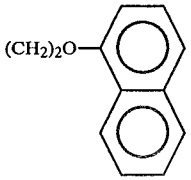 | 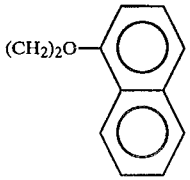 | H | H | H | 3 | $I^{\ominus}$ | 1 |

-continued
| | | | | | | | | |
|---|---|---|---|---|---|---|---|---|
| B-11 | $\text{-}(CH_2)_2S(CH_2)_2SCH_3$ | $\text{-}(CH_2)_2S(CH_2)_2SCH_3$ | 6-$CH_3$ | 6-$CH_3$ | H | 3 | $I^{\ominus}$ | 1 |
| B-12 | 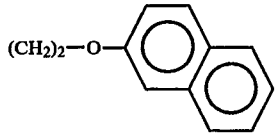 | 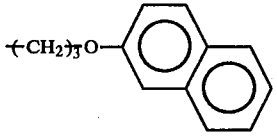 | H | H | H | 3 | $I^{\ominus}$ | 1 |
| B-13 | 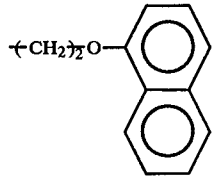 | $\text{-}(CH_2)_3S(CH_2)_2SCH_3$ | H | H | H | 3 | $I^{\ominus}$ | 1 |
| B-14 | 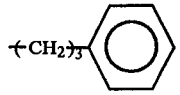 | 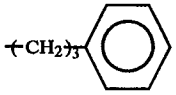 | H | H | H | 3 | $I^{\ominus}$ | 1 |
| B-15 | $\text{-}(CH_2)_2S(CH_2)_2S(CH_2)_2CH$ | $\text{-}(CH_2)_2S(CH_2)_2S(CH_2)_2CH$ | H | H | H | 3 | $I^{\ominus}$ | 1 |
Note: ph = phenyl group
B-16
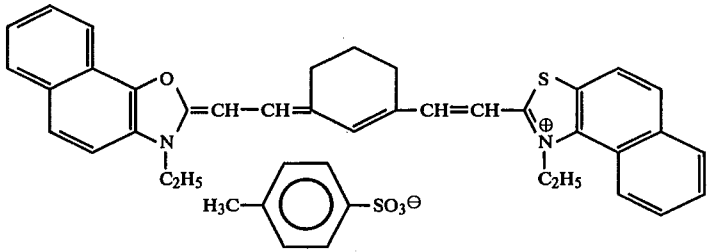
B-17
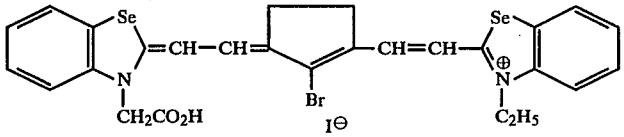

-continued
B-18
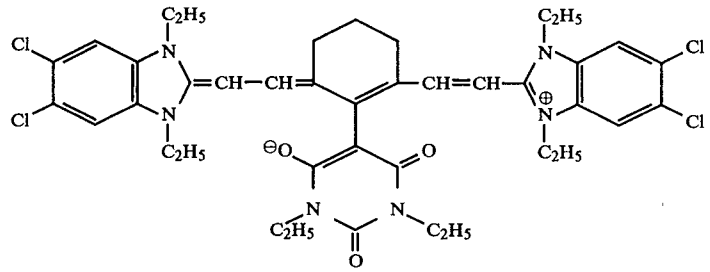
B-19
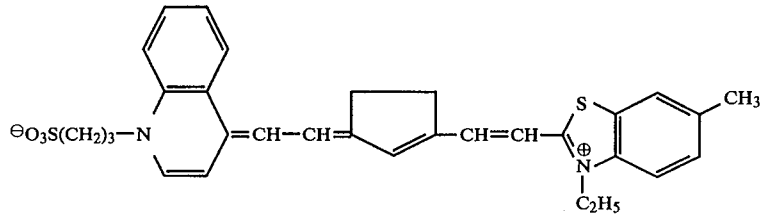
(II)-(b)
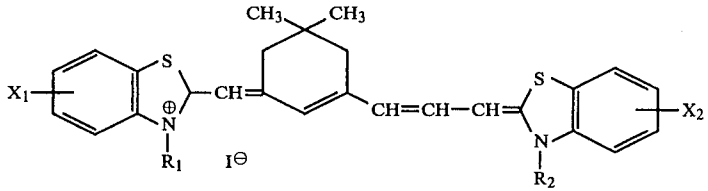
| Dye No. | $R_1$ | $R_2$ | $X_1$ | $X_2$ |
|---|---|---|---|---|
| B-20 | $C_2H_5$ | 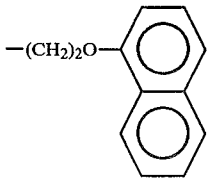 | 6-$OCH_3$ | 6-$OCH_3$ |

-continued
| | | | | |
|---|---|---|---|---|
| B-21 | $C_2H_5$ | 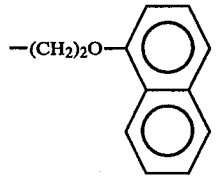 | 6,7-benzo | 5,6-$(OCH_3)_2$ |
| B-22 | 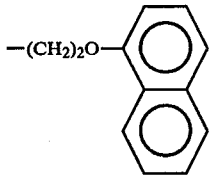 | 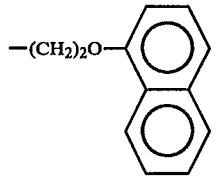 | 6,7-benzo | 5,6-$(OCH_3)_2$ |
| B-23 | $(CH_2)_2S(CH_2)_2S(CH_2)_2OH$ | 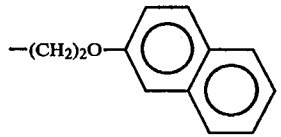 | 6,7-benzo | 6-$CH_3$ |
| B-24 | $(CH_2)_3S(CH_2)_2CH_3$ | 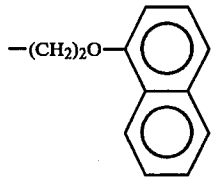 | 6,7-benzo | 6-$CH_3$ |
| B-25 | 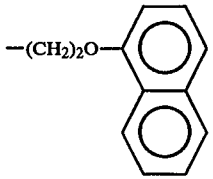 | 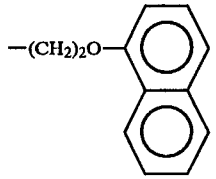 | 6-$OCH_3$ | 6,7-benzo |
| B-26 | 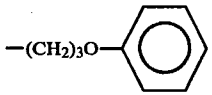 | 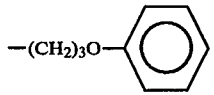 | 5,6-$(OCH_3)_2$ | 6,7-benzo |

-continued
| | | | | |
|---|---|---|---|---|
| B-27 | 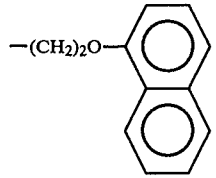 | 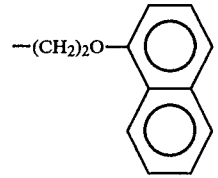 | H | H |
| B-28 | $C_2H_5$ | 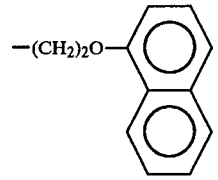 | H | H |

The dyes represented by formula (II) described above can be synthesized based on the methods known in the art and described in the following publications and patents.

That is, these methods are described in *Zh. Org. Khim.*, Vol. 17, No. 1, 167–169 (1981), ibid., Vol. 15, No. 2, 400–407 (1979), ibid., Vol. 14, No. 10, 2214–2221 (1978), ibid., Vol. 13, No. 11, 2440–2443 (1977), ibid., Vol. 19, No. 10, 2134–2142 (1983), *Ukr. Khim. Zh.*, Vol. 40, No. 6, 625–629 (1974), *Khim. Geterotsikl. Soedin.*, No. 2, 175–178 (1976), Russian Patents 420,643 and 341,823, JP-A-59-217761, U.S. Pat. Nos. 4,334,000, 3,671,648, 3,623,881, and 3,573,921, European Patents 288,261A1, 102,781A2, and JP-B-49-46930 (the term "JP-B" as used herein refers to an "examined Japanese patent publication").

The sensitizing dyes for use in the present invention may be used alone or in combination, or in combination with another known sensitizing dye.

The silver halide emulsion in the second embodiment of the present invention may contain a dye having no spectral sensitizing action by itself, or a compound which does not substantially absorb visible light, and exhibits a super color sensitization effect as described, e.g., in U.S. Pat. No. 3,615,641 and JP-A-63-23145.

In the second embodiment of the present invention, the sensitizing dye may be added to a silver halide emulsion before, during or after chemical ripening thereof or before or after the nucleation of the silver halide grains, according to the methods described in U.S. Pat. Nos. 4,183,756 and 4,225,666. The addition amount of the sensitizing dye is from about $1\times10^{-8}$ to $1\times10^{-2}$ mol per mol of silver halide.

Also, as other method of obtaining the spectral sensitivity characteristics in the second embodiment of the present invention, at least one layer of the silver halide emulsion layers having a maximum spectral sensitivity at a wavelength of at least 790 nm or at least one of light-insensitive layers disposed above at least one of said silver halide emulsion layers having said maximum spectral sensitivity and close to a light source may comprise a dye which does not spectrally sensitize a silver halide but absorbs light of a wavelength more than 60 nm shorter than said maximum spectral sensitivity wavelength of at least 790 nm. The light-insensitive layers may be, for example, an interlayer, a protective layer, an antiirradiation layer and an antihalation layer. Also, it is desirable that the dye is decolored or does not transfer during heat development.

Also, the dye-providing compound itself, which is used for providing dye images, may have the above described function, i.e., a colored dye-providing coupler may be used.

Examples of the above described dye for use in the present invention are cyanine dyes, oxonol dyes, merocyanine dyes, hemioxonol dyes, polymethine dyes, azulenium series dyes, polymethine series dyes (such as pyrrylium series dyes, thiapyrrylium series dyes), azaazulene series metal complex dyes (such as phthalocyanine metal complexes, naphthalocyanine metal complexes), azomethine dyes (such as azo dyes, naphthoquinone series dyes, anthraquinone series dyes, indophenol dyes), metal complexes (such as bis(1,2-benzene dithiolate)nickel), triarylmethane series dyes (such as triphenylmethane, crystal violet, triindolylmethane), and fluoran series dyes.

The above described dye can be added to a hydrophilic colloid layer as a solid fine particular dispersion, a dispersion of fine droplets of a high boiling oil having the dye dissolved therein, an aqueous solution or a solution in an organic solvent, or a dispersion of fine solid particles such as a colloidal silica gel having adsorbed thereto the dye.

Alternatively, the dye can be used in a state of dyeing a polymer having positive charges, such as an ammonium, or a polymer having negative charges such as sulfonic acid.

The heat-developable color light-sensitive material of the present invention includes at least a support having thereon at least three different color sensitive layers each containing a light-sensitive silver halide, a dye-providing compound (which functions, as the case may be, as a reducing agent as will be described below), and a binder, and each layer may, if necessary, further contain an organic metal salt oxidizing agent.

These components are, in many cases, contained in the same layer but if some components are in a reactive state, they may be exist in separate layers. For example, if a colored dye-providing compound exists in a layer under a silver halide emulsion layer, it prevents the reduction of the sensitivity of the silver halide emulsion. Also, it is preferred that a reducing agent is incorporated in the heat-developable color light-sensitive material but it may be supplied from outside by a method of diffusing the reducing agent from a dye-fixing material as will be described below.

For obtaining colors of wide ranges in a chromatic diagram using the three primary colors of yellow, magenta, and cyan, at least three silver halide emulsion layers each having a light sensitivity in a different spectral region are used as a combination thereof.

For example, there are a combination of a blue-sensitive layer, a green-sensitive layer, and a red-sensitive layer, and a combination of a green-sensitive layer, a red-sensitive layer, and an infrared-sensitive layer. These light-sensitive layers can employ various disposition orders which are known for ordinary color photographic light-sensitive materials. Also, each light-sensitive layer may, if necessary, be composed of two or more layers.

The heat-developable color light-sensitive material of the present invention may further have various auxiliary layers such as protective layer(s), a subbing layer, interlayers, a yellow filter layer, an antihalation layer, backing layer(s).

The silver halide which can be used in the present invention includes silver chloride, silver bromide, silver iodobromide, silver chlorobromide, silver chloroiodide, and silver chloroiodobromide.

The silver halide emulsion for use in the present invention may be a surface latent image-type emulsion or an internal latent image-type emulsion. The internal latent image-type is used as a direct reversal emulsion by combining with a nucleating agent and a light fogging agent. Also, a core/shell type silver halide emulsion having a different phase between the inside of the grain and the surface layer of the grain can be used in the present invention. Furthermore, the silver halide emulsion may be monodisperse or polydisperse, or a mixture of a monodisperse type emulsion and a polydisperse type emulsion may be used.

The grain sizes of the silver halide grains for use in the present invention are preferably from 0.1 to 2 μm, and particularly preferably from 0.2 to 1.5 μm. The crystal habit of the silver halide grains may be cubic, octahedral, tetradecahadeal, or tabular having a high aspect ratio.

The silver halide emulsions described in U.S. Pat. Nos. 4,500,626 and 4,628,021, *Research Disclosure*, No. 17029 (1978), and JP-A-62-253159 can be used in the present invention.

The silver halide emulsion may be used as a primitive emulsion but is usually chemically sensitized. For the silver halide emulsion of an ordinary photographic light-sensitive material, a sulfur sensitizing method, a reduction sensitizing method, and a noble metal sensitizing method can be used individually or as a combination thereof. The chemical sensitization can be carried out in the presence of a nitrogen-containing heterocyclic compound as described in JP-A-62-253159.

The coating amount (coverage) of the light-sensitive silver halide used in the present invention is in the range of 1 mg/m$^2$ to 10 g/m$^2$ calculated as silver.

In the present invention, an organic metal salt can be used together with a light-sensitive silver halide as an oxidizing agent. In these organic metal salts, organic silver salts are particularly preferably used.

Examples of the organic compound capable of forming the above described organic silver salt oxidizing agent are benzotriazoles described in U.S. Pat. No. 4,500,626, columns 52–53. Also, silver salts of carboxylic acid having an alkynyl group, such as silver phenylpropiolate described in JP-A-60-113235 and acetylene silver described in JP-A-61-249044, are useful in the present invention. These organic silver salts may be used singly or as a mixture thereof.

The organic silver salt described above can be used in an amount of from 0.01 to 10 mols, and preferably from 0.01 to 1 mol per mol of the light-sensitive silver halide. The sum of the coating amount of the light-sensitive silver halide and the organic silver salt is from 50 mg/m$^2$ to 10 g/m$^2$.

In the present invention, various antifoggants or photographic stabilizers can be used for the heat-developable color light-sensitive material. Examples of them are azoles and azaindenes described in *Research Disclosure*, No. 17643 (1978), pages 24–25, carboxylic acids containing nitrogen and phosphoric acids described in JP-A-59-168442, mercapto compounds and the metal salts thereof described in JP-A-59-111636, and acetylene compounds described in JP-A-62-87957.

As a binder for layers constituting the heat-developable color light-sensitive material of the present invention and a dye-fixing material, a hydrophilic polymer is preferably used. Examples thereof are described in JP-A-62-253159.

A transparent or translucent hydrophilic binder is preferred and examples thereof are proteins such as gelatin, gelatin derivatives, natural compounds such as cellulose derivatives and polysaccharides (e.g., starch, gum arabic, dextrane, and pluran), and synthetic polymers such as polyvinyl alcohol, polyvinylpyrrolidone, and acrylamide polymer. Also, high water absorptive polymers described in JP-A-62-245260, that is, a homopolymer of a vinyl monomer having —COOM or —$SO_3M$ (wherein M represents hydrogen or an alkali metal) or copolymers of the vinyl monomers or the vinyl monomer and other vinyl monomer (e.g., sodium methacrylate, ammonium methacrylate, Sumika Gel L-5H, trade name, made by Sumitomo Chemical Company, Ltd.) can be used. These binders may be used singly or as a combination thereof.

When performing the heat development by supplying a slight amount of water, by using the above described high water-absorptive polymer, water can be quickly absorbed. Also, when the high water-absorptive polymer is used for the dye-fixing layer or the protective layer thereof, dyes can be prevented from retransferring from the dye-fixing material into others after the dye transfer.

In the present invention, the coating amount of a binder is preferably not more than 7 g/m$^2$, more preferably not more than 10 g/m$^2$ and particularly preferably not more than 7 g/m$^2$ of the heat-developable color light-sensitive material.

The layers (including backing layers of the light-sensitive material and/or the dye-fixing material may contain various polymer latexes for improving film properties such as dimensional stability, curling prevention, sticking prevention, cracking prevention of films, prevention of pressure sensitivity increase or pressure desensitization. Examples of polymer latexes which can be used in the present invention are described in JP-A-62-245258, JP-A-62-136648, and JP-A-62-110066.

In particular, when a polymer latex having a low glass transition point (lower than 40° C.) is used for a mordant layer, the occurrence of cracking of the mordant layer can be prevented and when a polymer latex having a high glass transition point is used for the backing layer, a curling preventing effect is obtained.

The heat-developing color light-sensitive material of the present invention contains a reducing agent, and as the reducing agent, those known in the field of heat-developable light-sensitive materials can be used. Also, a dye-providing compound having a reducing property, described below, is included as such a reducing agent (in this case, another reducing agent may be used in combination). Also, a reducing agent precursor which does not have a reducing property by itself but shows a reducing property by the action of a nucleating reagent or heating in the development step, may be used.

Examples of the reducing agent and the reducing agent precursor for use in the present invention are described in U.S. Pat. No. 4,500,626, column 49–50, U.S. Pat. No. 4,483,914, columns 30–31, U.S. Pat. Nos. 4,330,617 and 4,590,152, JP-A-60-140335, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-A-60-198540, JP-A-60-181742, JP-A-61-259253, JP-A-62-244044, JP-A-62-131253, JP-A-62-131254, JP-A-62-131255, and JP-A-62-131256, and European Patent 220,746A2, pages 78–96.

Combinations of various reducing agents disclosed in U.S. Pat. No. 3,039,869 can be also used in the present invention.

In the case of using a nondiffusible reducing agent, for accelerating the electron transfer between the nondiffusible reducing agent and a developable silver halide, an electron transmitting agent and/or an electron transmitting agent precursor can be used.

The electron transmitting agent or the precursor thereof can be selected from the above described reducing agents or the precursors thereof. It is desirable that the electron transmitting agent or the precursor thereof has a larger transferring property than the nondiffusible reducing agent (electron donor). The particularly useful electron transmitting agents are 1-phenyl-3-pyrazolidones or aminophenols.

As the nondiffusible reducing agent (electron donor) which is used as a combination with the electron transmitting agent, the above described reducing agents which do not substantially move in the layers of the heat-developable color light-sensitive material can be used and preferred examples thereof are hydroquinones, sulfonamidophenols, sulfonamidonaphthols, the compounds described in JP-A-53-110827 as an electron donor, and nondiffusible dye-providing compounds having a reducing property can be used.

In the present invention, the addition amount of the reducing agent is from 0.001 to 20 mols, and preferably from 0.01 to 10 mols per mol of silver.

In the present invention, as an image-forming material, silver can be used. Also, the heat-developable color light-sensitive material of the present invention can contain a dye-providing compound, i.e., a compound capable of forming or releasing a mobile dye corresponding or counter-corresponding to the reaction of reducing a silver ion into silver under a high temperature state.

Examples of the dye-providing compound which can be used in the present invention are first compounds (couplers) forming dyes by an oxidative coupling reaction. The coupler may be a 4-equivalent coupler or a 2-equivalent coupler. Also, a 2-equivalent coupler having a nondiffusible group as a releasable group and forming a diffusible dye by an oxidative coupling reaction is preferably used in the present invention. The nondiffusible group may form a polymer chain.

Practical examples of color developing agents and coupler are described, in detail, in T. H. James, *The Theory of the Photographic Process*, pages 291–334 and pages 354–361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, and JP-A-60-66249.

Also, as other examples of the dye-providing compound, there are compounds having a function of imagewise releasing or diffusing a diffusible dye. The compound of this type is represented by formula (LI):

$$(\text{Dye-Y})_n\text{-Z} \qquad \text{(LI)}$$

wherein Dye represents a dye group, a dye group temporarily shifted to a shorter wavelength side, or a dye precursor group; Y represents a simple bond or a linkage group; Z represents a group having a property of causing a difference in diffusibility of the compound represented by $(\text{Dye-Y})_n$-Z corresponding or counter-corresponding to a light-sensitive silver salt having imagewise latent images or a property of releasing Dye and causing a difference in diffusibility between Dye thus released and $(\text{Dye-Y})_n$-Z; and n represents 1 or 2, when n is 2, two (Dye-Y) groups may be the same or different.

Examples of the dye-providing compound represented by formula (LI) include the following compounds (1) to (5). In addition, the following compounds (1) to (3) form diffusible dye images (positive dye images) counter-corresponding to the development of silver halide and the compounds (4) and (5) form diffusible dye images (negative images) corresponding to the development of silver halide.

(1) Dye developing agents each formed by linking a hydroquinone series developing agent and a dye component described in U.S. Pat. Nos. 3,134,764, 3,362,819, 3,597,200, 3,544,545, and 3,482,972. The dye developing agent is diffusible under an alkaline condition but becomes nondiffusible on reacting with a silver halide.

(2) A nondiffusible compound which releases a diffusible dye under an alkaline condition but loses the function on reaction with a silver halide as described in U.S. Pat. No. 4,503,137. Examples of the compound are the compound releasing a diffusible dye by an intramolecular nucleophilic substitution reaction described in U.S. Pat. No. 3,980,479 and the compound releasing a diffusible dye by an intramolecular rewinding reaction of an isooxazoline ring described in U.S. Pat. No. 4,199,354.

(3) Nondiffusible compounds each releasing a nondiffusible dye by reacting with a reducing agent remaining without being oxidized by the development as described in U.S. Pat. No. 4,559,290, European Patent 220,746A2, U.S. Pat. No. 4,783,396, *Kookai Gihoo*, 87–6199.

Examples of the compound are the compounds releasing a diffusible dye by an intramolecular nucleophilic substitution reaction after being reduced described in U.S. Pat. Nos. 4,139,389 and 4,139,379, JP-A-59-185333 and JP-A-57-84453, the compounds releasing a diffusible dye by an intramolecular electron transfer reaction after being reduced described in U.S. Pat. No. 4,232,107, JP-A-59-101649, JP-A-61-88257, and *Research Disclosure*, No. 24025 (1984), the compounds releasing a diffusible dye by cleaving a single bond after being reduced described in West German Patent 3,008,588A, JP-A-56-142530, U.S. Pat. Nos. 4,343,893 and 4,619,884, the nitro compounds releasing a diffusible dye after receiving an electron described in U.S. Pat. No. 4,609,610, and the compounds releasing a diffusible dye after receiving an electron described in U.S. Pat. No. 4,609,610.

More preferred examples of the above described compound are the compounds having an N—X bond (wherein X represents oxygen, sulfur or nitrogen) and an electron attractive group in one molecule described in European Patent 220,746A2, *Kookai Gihoo*, 87–6199, U.S. Pat. No. 4,783,396, JP-A-63-201653, and JP-A-63-201654, the compounds having $SO_2$—X (wherein X is the same as above) and an electron attractive group in one molecule described in JP-A-1-26842, the compounds having a PO—X bond (wherein X is the same as above) and an electron attractive group in one molecule described in JP-A-63-271344, and the compounds having a C—X′ bond (wherein X′ is the same as described above or represents —$SO_2$—) and an electron attractive group described in JP-A-63-271341.

Also, the compounds releasing a diffusible dye by cleaving a single bond after being reduced by a $\pi$ bond conjugated with an electron acceptive group described in JP-A-1-161237 and JP-A-1-161342 can be utilized in the present invention.

In the above described compounds, the compound having an N—X bond and an electron attractive group in one molecule is preferred. Examples of the preferred compound are compounds (1) to (3), (7) to (10), (12), (13), (15), (23) to (26), (31), (32), (35), (36), (40), (41), (44), (53) to (59), (64), and (70) described in European Patent 220,746A2 or U.S. Pat. No. 4,783,396, and compounds (11) to (23) described in *Kookai Gihoo*, 87–6199.

(4) Compounds (DDR couplers) which are couplers having a diffusible dye as the releasable group and release a diffusible dye by the reaction with the oxidation product of a reducing agent. Practical examples of the compound are described in British Patent 1,330,524, JP-B-48-39165, U.S. Pat. Nos. 3,443,940, 4,474,867, and 4,483,914.

(5) Compounds (DRR compounds) which are reactive to a silver halide or an organic silver salt and release a diffusible dye by reducing it. The use of the compound is preferred since the use of another reducing agent is unnecessary and there is no problem of staining images by the oxidation decomposition of a reducing agent.

Typical examples of the DRR compound are described in U.S. Pat. Nos. 3,928,312, 4,053,312, 4,055,428, and 4,336,322, JP-A-59-65839, JP-A-59-69839, JP-A-53-3819, JP-A-51-104343, *Research Disclosure*, No. 17465, U.S. Pat. Nos. 3,725,062, 3,728,113, and 3,443,939, JP-A-58-116537 and JP-A-57-179840, and U.S. Pat. No. 4,500,626.

As practical examples of the DRR compound, there are the compounds described in the above described U.S. Pat. No. 4,500,626, columns 22 to 44, and of these compounds, the compounds (1) to (3), (10) to (13), (16) to (19), (28) to (30), (33) to (35), (38) to (40), and (42) to (64) are preferred.

Also, the compounds described in U.S. Pat. No. 4,639,408, columns 37 to 39 are useful.

Furthermore, as other dye-providing compounds than the above described couplers and the compounds represented by formula (LI), dye-silver compounds wherein an organic silver salt is bonded to a dye described in *Research Disclosure*, No. 16966, pages 54–58 (May, 1978), azo dyes which are used for heat-developable silver dye bleaching method described in U.S. Pat. No. 4,235,957, *Research Disclosure*, No. 14433, pages 30–32 (April, 1976), and leuco dyes described in U.S. Pat. Nos. 3,985,565 and 4,022,617 can be also used.

Hydrophobic additives such as dye-providing compounds and nondiffusible reducing agents can be introduced into the layers of the heat-developable color light-sensitive material of the present invention by known methods such as the method described in U.S. Pat. No. 2,322,027. In this case, high boiling organic solvents described in JP-A-59-83154, JP-A-59-178451, JP-A-59-178452, JP-A-59-178453, JP-A-59-178454, JP-A-59-178455, JP-A-59-178457 can be used together with, if necessary, a low boiling organic solvent having a boiling point of from 50° C. to 160° C.

The amount of the high boiling organic solvent is not more than 10 g, and preferably not more than 5 g per gram of the dye-providing compound being used. Also, the amount of the organic solvent is not more than 1 ml, preferably not more than 0.5 ml, and particularly preferably not more than 0.3 ml per gram of a binder being used.

The dispersion methods with polymers described in JP-B-51-39853 and JP-A-51-59943 can be used in the present invention.

In the case of using a compound substantially insoluble in water, the compound can be dispersed as fine particles thereof in a binder.

When dispersing hydrophobic compounds in an aqueous solution of a hydrophilic colloid, various surface active agents can be used. For example, the surface active agents described in JP-A-59-147636 can be used.

In the present invention, a compound which can activate the development and at the same time stabilize the images obtained can be used for the light-sensitive material. Practical examples of the aforesaid compound being preferably used are described in U.S. Pat. No. 4,500,626.

In the system of forming images by the diffusion transfer of dyes, a dye-fixing material is used with the heat-developable color light-sensitive material.

The dye-fixing material includes a dye-fixing layer formed on a different support than that of the heat-developable color light-sensitive material, and a dye-fixing layer formed on the same support as the light-sensitive material.

The relation of light-sensitive material and the dye-fixing material, the relation of the light-sensitive material and the supports thereof and the dye-fixing material, and the relation of the above described materials and a white reflective layer described in U.S. Pat. No. 4,500,626, column 57 can be used in the present invention.

The dye-fixing material which is preferably used in the present invention has at least one layer containing a mordant and a binder. As the mordant, those known in the photographic field can be used. Practical examples of the mordant are described in U.S. Pat. No. 4,500,626, columns 58–59 and JP-A-61-88256 and those described in JP-A-62-244043 and JP-A-62-244036. Also, the dye-accepting high molecular compounds described in U.S. Pat. No. 4,463,079 may be used.

The dye-fixing material may have, if necessary, auxiliary layers such as a protective layer, a releasing layer, a curling preventing layer, etc. In particular, a protective layer is useful.

The layers of the heat-developable color light-sensitive material of the present invention and the dye-fixing layer can further contain a lubricant, a plasticizer, or a high boiling organic solvent as a releasing property improving agent between the light-sensitive material and the dye-fixing material. Practical examples thereof are described in JP-A-62-253159 and JP-A-62-245253.

Furthermore, for the aforesaid purposes, various kinds of silicone oils (any silicone oils such as dimethyl silicone oil, modified silicone oils obtained by introducing various kinds of organic groups into dimethylsiloxane) can be used. Practical examples thereof are various modified silicone oils described in *Modified Silicone Oil*, P6-18B published by Shin-Etsu Silicone K.K., and in particular, carboxy-modified silicone, X-22-3710 (trade name, made by Shin Etsu Silicone K.K.) is effective.

Also, the silicone oils described in JP-A-62-215953 and JP-A-63-46449 are effective.

For the heat-developable color light-sensitive material and the dye-fixing material, a fading inhibitor may be used. The fading inhibitor includes, for example, antioxidants, ultraviolet absorbents, and certain kinds of metal complexes.

The antioxidant includes, for example, chroman series compounds, coumaran series compounds, phenol series compounds (e.g., hindered phenols), hydroquinone derivatives, hindered amine derivatives, and spiroindane series compounds. Also, the compounds described in JP-A-61-159644 are effective.

As the ultraviolet absorbent, there are benzotriazole series compounds described in U.S. Pat. No. 3,533,794, 4-thiazolidone series compounds described in U.S. Pat. No. 3,352,681, benzophenone series compounds described in JP-A-46-2784, and other compounds described in JP-A-54-48535, JP-A-62-136641, and JP-A-61-88256. Also, the ultraviolet absorbing polymers described in JP-A-62-260152 are effective.

As the metal complexes, there are the compounds described in U.S. Pat. Nos. 4,241,155, 4,245,018, columns 3 to 36, 4,254,195, columns 3 to 8, JP-A-62-

174741, JP-A-61-88256, JP-A-63-199248, JP-A-1-75568 and JP-A-1-74272.

Also, examples of useful fading inhibitors are described in JP-A-62-215272, pages 125 to 137.

The fading inhibitor for inhibiting fading of the dyes transferred into the dye-fixing material may be previously incorporated in the color-fixing material or may be supplied to the dye-fixing material from outside such as from the light-sensitive material.

The above described antioxidant, ultraviolet absorbent, and metal complex may be used as a combination thereof.

For the light-sensitive material and the dye-fixing material, an optical whitening agent may be used. In this case, it is particularly preferred that the optical whitening agent is incorporated in the dye-fixing material or is supplied thereto from the light-sensitive material.

Examples of the optical whitening agent are described in K. Veenkataraman, *The Chemistry of Synthetic Dyes*, Vol. V, Chapter 8, and JP-A-61-143752. More practically, there are stilbene series compound, coumarin series compounds, biphenyl series compounds, benzoxazolyl series compounds, naphthalimide series compounds, pyrazoline series compounds, and carbostyryl series compounds.

The optical whitening agent can be used in combination with a fading inhibitor.

A hardening agent used for the constituting layers of the heat-developable color light-sensitive material and the dye-fixing material includes the hardening agents described in U.S. Pat. No. 4,678,739, column 41, JP-A-50-116655, JP-A-62-245261, and JP-A-61-18942. These include aldehyde series hardening agents (e.g., formaldehyde), aziridine series hardening agents, epoxy series hardening agents

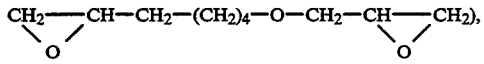

vinylsulfone series hardening agents (e.g., N,N'-ethylene-bis(vinylsulfonylacetamido)ethane), N-methylol series hardening agents (e.g., dimethylolurea), and high molecular hardening agents (e.g., the compounds described in JP-A-62-234157).

Also, for the constituting layers of the heat-developable color light-sensitive material and the dye-fixing material, various surface active agents can be used for the purposes of coating aid, releasability improvement, static prevention, or development acceleration. Practical examples of the surface active agent are described in JP-A-62-173463 and JP-A-62-183457.

The layers of the heat-developable color light-sensitive material and the dye-fixing material may contain organic fluoro compounds for improving slidability, static prevention, or releasability improvement. Typical examples of the organic fluoro compound are fluorine series surface active agents described in JP-B-57-9053, JP-A-61-20944, and JP-A-62-135826, and hydrophilic fluorine compounds, for example, oil-like fluorine compounds such as fluorine oil, and solid fluorine compound resins such as an ethylene tetrafluoride resin.

The heat-developable color light-sensitive material and the dye-fixing material may contain a matting agent. As the matting agent, there are silicon dioxide, the compounds such as polyolefin and polymethacrylate described in JP-A-61-88256, and also benzoguanamine resin beads, polycarbonate resin beads, and AS resin beads described in JP-A-63-274944 and JP-A-63-274952.

Moreover, the layers constituting the heat-developable color light-sensitive material and the dye-fixing material may contain a heat solvent, a defoaming agent, an antibaceterial agent, an antifungal agent, colloidal silica. Practical examples of these additives are described in JP-A-61-88256.

In the present invention, for the heat-developable color light-sensitive material and/or the dye-fixing material, an image formation accelerator can be used. The image formation accelerator has functions of accelerating the oxidation reduction reaction of a silver salt oxidizing agent and a reducing agent, accelerating the reactions such as the formation of dyes from the dye-providing materials, the decomposition of dyes, the release of diffusible dyes, and accelerating the transfer of dyes from the heat-developable color light-sensitive material into the dye-fixing layer. From their physicochemical functions, the image formation accelerators are classified into a base or a base precursor, a nucleophilic compound, a high boiling organic solvent (oil), a heat solvent, a surface active agent, and a compound having an interaction with silver or silver ions. However, these materials have generally composite functions and usually provide plural acceleration effects described above. Details of the accelerator are described in U.S. Pat. No. 4,678,739, columns 38–40.

The base precursor includes a salt of an organic acid which undergoes decarboxylation by heating and a base and a compound releasing an amine by an intramolecular nucleophilic substitution reaction, a Lossen rearrangement, or a Beckmann rearrangement. Practical examples thereof are described in U.S. Pat. No. 4,511,493 and JP-A-62-65038.

In the system of simultaneously carrying out the heat development and the transfer of dyes in the presence of a small amount of water, it is preferred to incorporate a base and/or a base precursor for improving the storage stability of the light-sensitive material.

Furthermore, a combination of a sparingly soluble metal compound and a compound capable of causing a complex-forming reaction (the compound is referred to as a complex-forming compound) with the metal ion constituting the sparingly soluble metal compound described in European Pat. No. Publication (unexamined) 210,660 and U.S. Pat. No. 4,740,445 and the compound forming a base by an electrolysis described in JP-A-61-232451 can be also used as the base precursors. The former combination is particularly effective. It is useful that the sparingly soluble metal compound and the complex-forming compound are separately incorporated in the light-sensitive material and the dye-fixing material, respectively.

For the heat-developable color light-sensitive material of the present invention and/or the dye-fixing material, various development stopping agents can be used for obtaining definite images regardless of the deviations of the processing temperature and the processing time at development.

The development stopping agent is a compound capable of stopping the development by quickly neutralizing a base or reacting with a base after an optimum development to reduce the base in the layers or a compound capable of controlling the development by interacting with silver or a silver salt. Practically, there are an acid precursor releasing an acid by heating, an electrophilic compound causing a substitution reaction with an existing base by heating, a nitrogen-containing heterocyclic compound, a mercapto compound and the precursor thereof. Details thereof are described in JP-A-62-253159.

As the support for the heat-developable color light-sensitive material of the present invention and the dye-fixing material, a support material capable of enduring the processing temperature is used. In general, papers and synthetic polymers (films) are used, including polyethylene terephthalate, polycarbonate, polyvinyl chloride, polystyrene, polypropylene, polyimide, celluloses (e.g., triacetyl cellulose), films of the above described polymers containing a pigment such as titanium oxide, synthetic papers made with polypropylene, papers made from a mixture of a synthetic resin such as polypropylene and natural pulp, Yankee papers, baryta-coated papers, coated papers (in particular, cast coat papers), metal plates, cloths, and glass sheets.

These supports can be used singly or as a paper support one or both surfaces of which are laminated with a synthetic polymer such as polyethylene.

Furthermore, the supports described in JP-A-62-253159 can be also used in the present invention.

On the surface of the support may be coated an anti-static agent, e.g., a semiconductive metal oxide such as alumina sol and tin oxide or carbon black together with a hydrophilic binder.

As a method of exposing and recording images on the heat-developable color light-sensitive material, there are a method of directly photographing a scene or a person using a camera, etc., a method of exposing through a reversal film or a negative film using a printer or an enlarger, a method of scanning exposing an original through a slit using an exposure device of a copying apparatus, a method of exposing by emitting light from a light emitting diode or various kinds of lasers by electric signals for image information, and a method of outputting an image information on an image display device such as CRT, a liquid crystal display, an electroluminescence display, or a plasma display and exposing the displayed information directly or through an optical system.

As a light source for recording images on the heat-developable color light-sensitive material, natural light, a tungsten lamp, a light emitting diode, a laser light source, or a CRT light source, described in U.S. Pat. No. 4,500,626, column 56 can be used.

Also, images can be exposed using a wavelength conversion element composed of a combination of a non-linear optical material and a coherent light source such as a laser light, etc. In this case, a non-linear optical material is a material capable of forming a non-linearity between the polarization appearing in the case of applying a strong photoelectric field such as laser light and the electric field. As the material, inorganic compounds such as lithium niobate, dihydrogen potassium phosphate (KDP), lithium iodate, $BaB_2O_4$, urea derivatives, nitroaniline derivatives, nitropyridine-N-oxide derivatives (such as 3-methyl-4-nitropyridine-N-oxide (POM)), and the compounds described in JP-A-61-53462 and JP-A-62-210432 are preferably used.

As the form of the wavelength conversion element, a single crystal type and a fiber type are known and are useful.

Also, as the above described image information, image signals obtained from a video camera, an electron still camera, television signals such as Nippon television signal standard (NTSC), image signals obtained by dividing an original into many picture elements by a scanner, or image signals formed using a computer such as CG and CAD.

As a heating means for heat development of the heat-developable color light-sensitive material of the present invention or diffusion transferring dyes into the dye-fixing material, an embodiment having an electric conductive heating layer may be employed.

In this case, as the transparent or opaque heating element, the element described in JP-A-61-145544 can be utilized. In addition, the electric conductive layer also functions as a static preventing layer.

The heating temperature at the heat development step is from about 50° C. to 250° C., but is preferably from about 80° C. to 180° C.

The diffusion transfer step of dyes may be carried out simultaneously with the heat development but may be carried out after finishing the the heat development step. In the latter case, the heating temperature in the transfer step may be in the range of the temperature in the heat development step to room temperature but is preferably in the range of from 50° C. to a temperature of about 10° C. lower than the temperature in the heat development step.

Dyes transfer may be accomplished by heating only but for accelerating the transfer of dyes, a solvent may be used.

For applying a solvent to the light-sensitive layer or the dye-fixing layer, the method described in JP-A-61-147244 can be employed. Also, a solvent can be microcapsuled and can be previously incorporated in the light-sensitive material or the dye-fixing material in the form of microcapsules.

Also, for accelerating the transfer of dyes, a system of incorporating a hydrophilic heat solvent which is solid at normal temperature but is dissolved at high temperature in the heat-developable color light-sensitive material or the dye-fixing material can be employed. The hydrophilic heat solvent may be incorporated in one or both of the light-sensitive material and the dye-fixing material. Also, the layer containing the hydrophilic heat solvent may be emulsion layers, interlayers, a protective layer, or a dye-fixing layer but it is preferred to incorporate the heat solvent in the dye-fixing layer and/or the adjacent layer.

Examples of the hydrophilic heat solvent are ureas, pyridines, amides, sulfonamides, imides, alcohols, oximes, and other heterocyclic rings.

Also, for accelerating the transfer of dyes, a high boiling organic solvent may be incorporated in the light-sensitive material and/or the dye-fixing material.

As a heating method in the heat development and/or the transfer step, there are a method of contacting with a heated block or plate, a method of contacting with a hot plate, hot pressure, a hot roller, a halogen lamp heater, an infrared or far infrared lamp heater, and a method of passing through a high temperature atmosphere.

As the pressure condition and a method of applying a pressure in the case of superposing the heat-developable light-sensitive material onto the dye-fixing material, the method described in JP-A-61-147244 can be applied.

For processing the photographic element of the present invention, various heat development apparatus can be used. For example, these apparatus are described in JP-A-59-75247, JP-A-59-177547, JP-A-59-181353, JP-A-60-18951, and JU-A-62-25944 (the term "JU-A" as used herein refers to an "unexamined published Japanese Utility Model Application").

Then, the present invention is now described in greater detail with reference to the following examples, but the present invention is not to be construed as being limited thereto. Unless otherwise indicated, all parts, ratios and percentages are by weight.

EXAMPLE 1

A silver halide emulsion (I) for the fifth layer was prepared as follows.

An aqueous gelatin solution was first obtained by dissolving 20 g of limed deionized bone gelatin (Ca content of 20 ppm), 4 g of sodium chloride, 0.1 g of potassium bromide, and 0.015 g of the compound represented by the following formula:

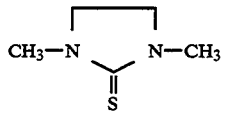

in 800 ml of water and kept at 65° C. To this solution were simultaneously added an aqueous silver nitrate solution (300 ml of a solution formed by dissolving 50 g of $AgNO_3$ in water) and an aqueous halide solution (300 ml of a solution formed by dissolving 22.8 g of KBr and 6 g NaCl in water) over a period of 30 minutes. Then, after reducing the temperature of the mixture to 35° C., an aqueous silver nitrate solution (300 ml of a solution formed by dissolving 50 g of $AgNO_3$ in water) and an aqueous halide solution (300 ml of a solution formed by dissolving 31.5 g of KBr and 1.7 g of NaCl in water) were simultaneously added to the mixture over a period of 30 minutes.

After washing with water and desalting, 25 g of limed gelatin (guanine content 50 ppm) and 100 ml of water were added, and the pH and pAg of the emulsion were adjusted to 6.3 and 7.9, respectively.

The silver halide emulsion obtained was kept at 55° C. and optimally chemically sensitized using 0.8 mg of triethylthiourea and 100 mg of 4-hydroxy-6-methyl-1,3,3a,7-tetraazaindene. The amount of the emulsion obtained was 650 g.

A silver halide emulsion (II) for the third layer was separately prepared as follows.

An aqueous solution of limed bone gelatin (ash content 0.4%, adenine content 0.2 ppm) was obtained by dissolving 50 g of gelatin, 10 g of sodium chloride, 0.1 g of potassium bromide, and 5 ml of (1N) sodium hydroxide in 800 ml of water kept at 60° C. To this solution were simultaneously added an aqueous silver nitrate solution (600 ml of a solution formed by dissolving 100 g of $AgNO_3$ in water) and an aqueous halide solution (600 ml of a solution formed by dissolving 54.5 g of KBr and 2 g of NaCl in water) with stirring well. One minute after finishing the addition, a dye solution obtained by dissolving 0.2 g of sensitizing dye (A) shown below and 0.2 g of sensitizing dye (B) shown below in 120 ml of methanol was added to the aforesaid mixture and after 5 minutes 10 ml of an aqueous 1% potassium iodide solution was added thereto.

Sensitizing Dye (A)

-continued

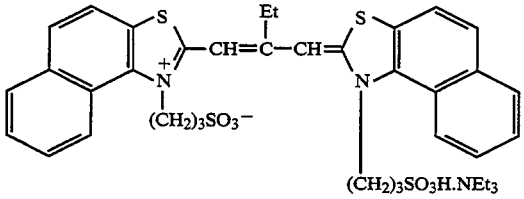

Sensitizing Dye (B)

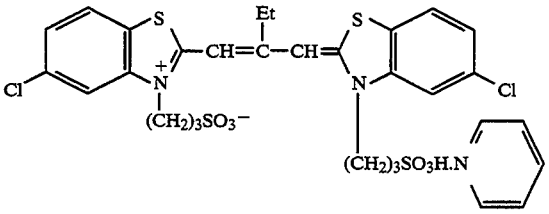

After washing with water and desalting, 10 g of limed bone gelatin (adenine content 20 ppm) and 50 ml of water were added to the emulsion and the pH and pAg thereof were adjusted to 6.0 and 7.6, respectively.

The silver halide emulsion obtained was kept at 60° C. and chemically ripened using 2.5 mg of sodium thiosulfate for 50 minutes. The amount of the emulsion obtained was 500 g.

A silver halide emulsion (III) for the first layer was separately prepared as follows.

An aqueous limed bone gelatin (Ca content 2,599 ppm) solution was obtained by dissolving 20 g of gelatin, 2 g of sodium chloride, and 0.015 g of the compound represented by formula:

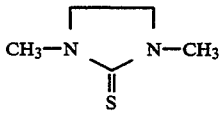

in 800 ml of water kept at 50° C. To this solution were simultaneously added the following solution I and solution II with stirring well; solution I was added over a period of 12 minutes and solution II was added over a period of 8 minutes. Sixteen minutes after finishing the addition of solution I, solution IV was added thereto over a period of 44 minutes and 20 minutes after finishing the addition of solution I, solution Ill was added thereto over a period of 40 minutes. Also, the pAg of the emulsion from the end of the addition of solution I to the introduction of solution III was 6.7.

| | Solution I (total 100 ml) | Solution II (total 60 ml) | | Solution III (total 500 ml) | Solution IV (total 540 ml) | |
|---|---|---|---|---|---|---|
| Emulsion III | $AgNO_3$ 15 g | KBr 4.9 g | NaCl 1 g | $AgNO_3$ 85 g | KBr 44.1 g | NaCl 9 g |

After washing with water and desalting, 25 g of limed gelatin (Ca content 4,000 ppm) and 100 ml of water were added to the emulsion, and the pH and pAg thereof were adjusted to 6.0 and 7.7, respectively. Thereafter, the silver halide emulsion was optimally chemically sensitized using 1.1 mg of triethylthiourea and 60 mg of 4-hydroxy-6-methyl-1,3,3a,7-tetraazaindene at 55° C.

The amount of the emulsion obtained was 650 g.

An organic silver salt was separately prepared as follows.

Organic Silver Salt (1):

A benzotriazole silver emulsion was prepared as follows.

After dissolving 28 g of gelatin in 1500 ml of water, a solution obtained by dissolving 6.6 g of benzotriazole in 12.7 ml of methanol was added to the solution. The resultant solution was stirred at 40° C. To the solution was added a solution of 8.5 g of silver nitrate dissolved in 120 ml of water over a period of 2 minutes. Furthermore, after adding thereto a solution of 6.6 g of benzotriazole dissolved in 12.7 ml of methanol and 56.5 ml of 2N sodium hydroxide, a solution of 8.5 g of silver nitrite dissolved in 1,700 ml of water was added to the solution over a period of 6 minutes.

Then, the pH of the solution was controlled to precipitate a benzotriazole silver emulsion and excess salts were removed. Thereafter, the pH was adjusted to 6.30 to provide 420 g of a benzotriazole silver emulsion.

Organic Silver Salt (2):

In a mixture of 1,000 ml of an aqueous solution of 0.1% sodium hydroxide and 200 ml of ethanol were dissolved 20 g of gelatin and 5.9 g of 4-acetylaminophenylpropiolic acid. The resultant solution was stirred at 40° C.

To the solution was added a solution of 4.5 g of silver nitrate dissolved in 200 ml of water over a period of 5 minutes.

Then, the pH of the dispersion was controlled to precipitate excess salts and the salts were removed. Thereafter, the pH thereof was adjusted to 6.3 to provide 300 g of a dispersion of organic silver salt (2).

A gelatin dispersion of a dye-providing material was separately prepared as follows.

In 45 ml of ethyl acetate were dissolved 15 g of yellow dye-providing material (A), 1.2 g of a reducing agent, 0.3 g of mercapto compound (1), 1.5 g of surface active agent (4), and 7.5 g of high boiling organic solvent (1) by heating to about 60° C. to provide a uniform solution. After mixing with stirring the solution with 100 g of an aqueous solution of 10% limed gelatin and 30 ml of water, the mixture was dispersed for 10 minutes with a homogenizer at 10,000 rpm, to produce a dispersion of the yellow dye-providing material.

In 25 ml of ethyl acetate were dissolved 15 g of magenta dye-providing material (B), 0.6 g of a reducing agent (R), 0.15 g of mercapto compound (1), 1.5 g of surface active agent (4), and 5.3 g of high boiling organic solvent (2) by heating to about 60° C. to provide a uniform solution. After mixing with stirring the solution with 100 g of an aqueous solution of 10% limed gelatin and 30 ml of water, the mixture was dispersed for 10 minutes with a homogenizer at 10,000 rpm, to produce a dispersion of the magenta dye-providing material.

In 30 ml of ethyl acetate were dissolved 15 g of cyan dye-providing material (C), 0.8 g of a reducing agent (R), 0.6 g of mercapto compound (1), 1.5 g of surface active agent (4), and 8.3 g of high boiling organic solvent (1) by heating to about 60° C. to provide a uniform solution. After mixing with stirring the solution with 100 g of an aqueous solution of 10% limed gelatin and 30 ml of water, the mixture was dispersed for 10 minutes with a homogenizer at 10,000 rpm, to produce a dispersion of the cyan dye-providing material.

By using the above-prepared compositions, a heat-developable light-sensitive material 100 shown below was prepared.

| Heat-Developable Light-Sensitive Material 100 | Coated Amount ($g/m^2$) |
|---|---|
| Sixth Layer: Protective Layer | |
| Gelatin | 0.72 |
| Matting Agent (colloidal silica) | 0.023 |
| Water-Soluble Polymer (1) | 0.18 |
| Surface Active Agent (1) | 0.051 |
| Surface Active Agent (2) | 0.090 |
| Surface Active Agent (3) | 0.029 |
| Hardening Agent (H) | 0.049 |
| Fifth Layer: Near Infrared Layer | |
| Emulsion (I) | 0.27 as Ag |
| Benzotriazole | $4.4 \times 10^{-3}$ |
| Sensitizing Dye (X) | $9.5 \times 10^{-4}$ |
| Yellow Dye-Providing Material (A) | 0.29 |
| High Boiling Organic Solvent (1) | 0.15 |
| Reducing Agent (R) | 0.023 |
| Mercapto Compound (1) | $5.8 \times 10^{-3}$ |
| Surface Active Agent (4) | 0.032 |
| Gelatin | 0.42 |
| Water-Soluble Polymer (2) | 0.016 |
| Fourth Layer: Interlayer | |
| Gelatin | 0.56 |
| $Zn(OH)_2$ | 0.24 |
| Benzotriazole | $3.4 \times 10^{-3}$ |
| Surface Active Agent (1) | $8.8 \times 10^{-3}$ |
| Surface Active Agent (5) | $4.6 \times 10^{-3}$ |
| Water-Soluble Polymer (2) | $6.4 \times 10^{-3}$ |
| Third Layer: Red-Sensitive Layer | |
| Emulsion (II) | 0.1 as Ag |
| Organic Silver Salt (1) | $3.8 \times 10^{-3}$ as Ag |
| Organic Silver Salt (2) | 0.016 as Ag |
| Magenta Dye-Providing Material (B) | 0.24 |
| High Boiling Organic Solvent (2) | 0.08 |
| Reducing Agent (R) | $9.5 \times 10^{-3}$ |
| Mercapto Compound (1) | $2.4 \times 10^{-3}$ |
| Surface Active Agent (5) | 0.023 |
| Gelatin | 0.31 |
| Water-Soluble Polymer (2) | $7.4 \times 10^{-3}$ |
| Surface Active Agent (4) | 0.026 |
| Second Layer: Interlayer | |
| Gelatin | 0.62 |
| $Zn(OH)_2$ | 0.19 |
| Surface Active Agent (1) | $5.9 \times 10^{-3}$ |
| Surface Active Agent (5) | $3.2 \times 10^{-3}$ |
| Surface Active Agent (6) | 0.056 |
| Water-Soluble Polymer (2) | $4.5 \times 10^{-3}$ |
| First Layer: Infrared-Sensitive Layer | |
| Emulsion (III) | 0.20 as Ag |
| Organic Silver Salt (1) | 0.032 as Ag |
| Organic Silver Salt (2) | 0.016 as Ag |
| Mercapto Compound (2) | $5.8 \times 10^{-4}$ |
| Sensitizing Dye (Y) | $2.5 \times 10^{-5}$ |
| Cyan Dye-Providing Material (C) | 0.26 |
| High Boiling Organic Solvent (1) | 0.14 |
| Reducing Agent (R) | 0.014 |
| Mercapto Compound (1) | 0.011 |
| Surface Active Agent (4) | 0.029 |
| Surface Active Agent (5) | $8.1 \times 10^{-3}$ |
| Water-Soluble Polymer (2) | 0.014 |
| Support: | |
| Polyethylene Terephthalate Film of 100 μm in Thickness. | |
| Back Layer: | |
| Carbon Black | 0.44 |
| Polyvinyl Chloride | 0.30 |

Yellow Dye-Providing Material (A):

-continued
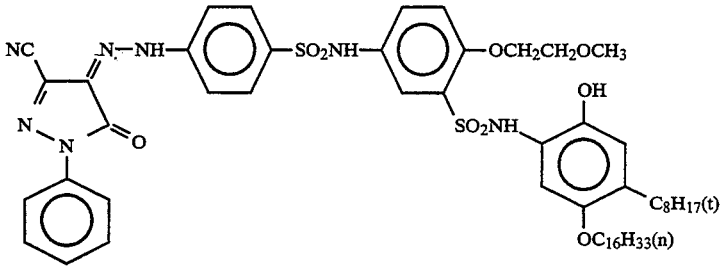
Magenta Dye-Providing Material (B):
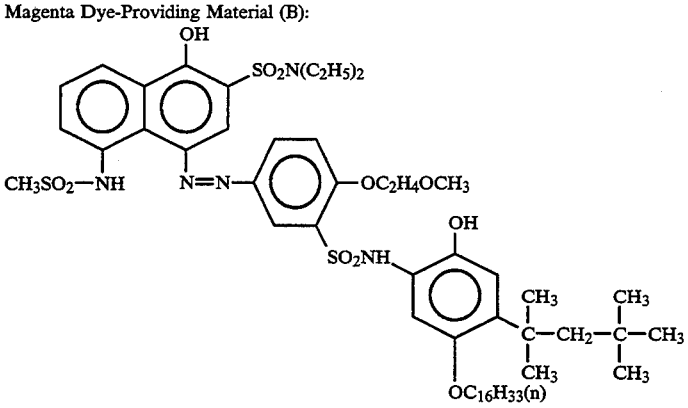
Cyan Dye-Providing Material (C):
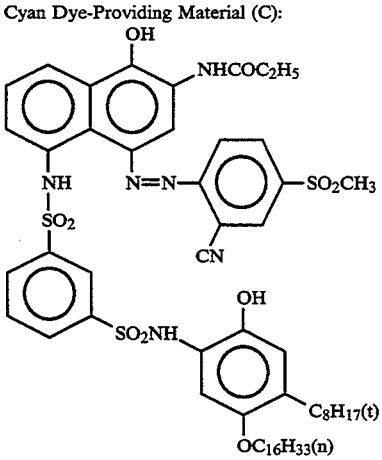
Water-Soluble Polymer (1):
Sumikagel L-5 (H) (manufactured by Sumitomo Chemical Co.)
Water-Soluble Polymer (2):
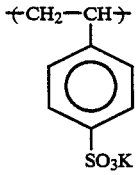
Surface Active Agent (1): Aerosol OT
Surface Active Agent (2):
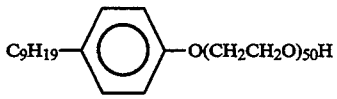
Surface Active Agent (3):
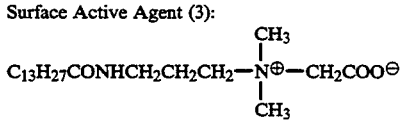

-continued
Surface Active Agent (4):
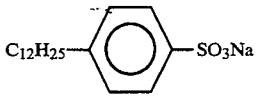
Surface Active Agent (5):
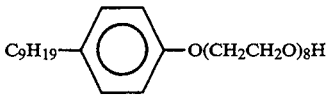
Surface Active Agent (6):
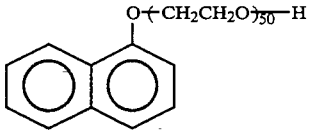
Hardening Agent (H):
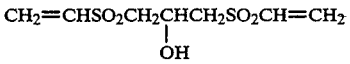
Sensitizing Dye (X):
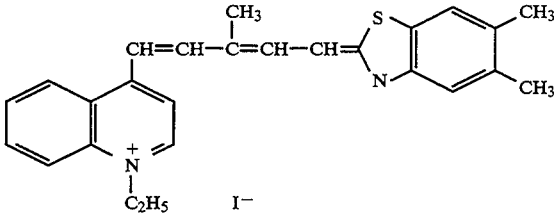
Sensitizing Dye (Y):
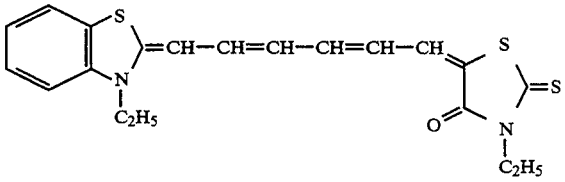
Reducing Agent (R):
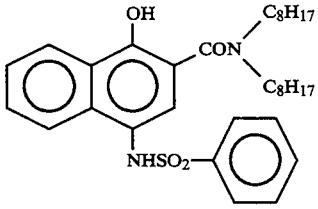
Mercapto Compound (1):
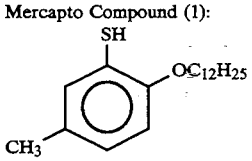
Mercapto Compound (2):
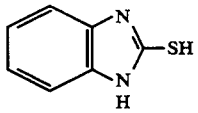
High Boiling Organic Solvent (1): Triisononyl Phosphate High Boiling Organic Solvent (2): Trihexyl Phosphate Preparation of the Heat-Developable Color Light-Sensitive Material of the Present Invention:

By following the same procedure as in preparing the above described light-sensitive material 100 except that in place of the sensitizing dye (X) in the fifth layer, sensitizing dye A-9 of the present invention was added at a coverage of $3.3\times10^{-4}$ g/m$^2$, such that the maximum sensitivity was the same as light-sensitive material 100, light-sensitive material 101 of the present invention was prepared.

Furthermore, by following the same procedure in preparing the above described light-sensitive material 100 except that sensitizing dye A-9 of the present invention was previously added to silver halide emulsion (I) in the fifth layer at a coverage of $3.3\times10^{-4}$ g/m$^2$, such that the maximum sensitivity became the same as light-sensitive material 100, followed by adsorbing for 30 minutes to provide silver halide emulsion (I') and the emulsion (I') was used in place of silver halide emulsion (I) without further addition of another sensitizing dye, light-sensitive material 2 of the present invention was prepared.

A dye-fixing material was prepared as follows.

Dye-fixing material R-1 was prepared by coating the following layers on a paper support laminated with polyethylene.

Construction of Dye-Fixing Material R-1:

| | Coating Amount (g/m$^2$) |
|---|---|
| Third Layer | |
| Gelatin | 0.05 |
| Silicone Oil *1 | 0.04 |
| Surface Active Agent *2 | 0.001 |
| Surface Active Agent *3 | 0.02 |
| Surface Active Agent *4 | 0.10 |
| Guanidine Picolate | 0.45 |
| Polymer *5 | 0.24 |
| Second Layer | |
| Mordant *6 | 2.35 |
| Polymer *7 | 0.60 |
| Gelatin | 1.40 |
| Polymer *5 | 0.21 |
| High Boiling Solvent *8 | 1.40 |
| Guanidine Picolate | 1.80 |
| Surface Active Agent *2 | 0.02 |
| First Layer | |
| Gelatin | 0.45 |
| Surface Active Agent *4 | 0.01 |
| Polymer *5 | 0.04 |
| Hardening Agent *9 | 0.30 |
| Paper Support | |
| Laminated with polyethylene (thickness 170 μm) | |
| Back Layer 1 | |
| Gelatin | 3.25 g |
| Hardening Agent *9 | 0.25 |
| Back Layer 2 | |
| Gelatin | 0.44 |
| Silicone Oil *1 | 0.08 |
| Surface Active Agent *2 | 0.002 |
| Matting Agent *10 | 0.09 |
| Surface Active Agent *11 | 0.01 |

Silicone Oil *1:

-continued

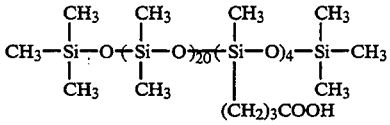

Surface Active Agent *2: Aerosol OT

Surface Active Agent *3:

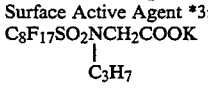

Surface Active Agent *4:

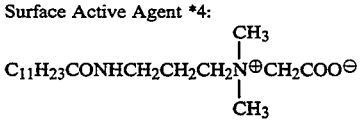

Surface Active Agent *11:

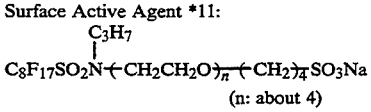

(n: about 4)

Polymer *5:
Vinyl Alcohol/Sodium Acrylate Copolymer
(75/25 mol ratio)

Polymer *7:
Dextran (molecular weight: 70,000)

Mordant *6:

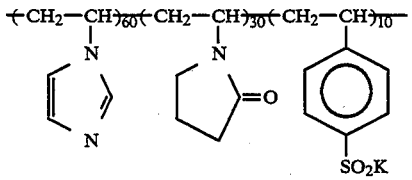

High Boiling Organic Solvent *8:
Reophos 95 (trade name, made by Ajinomoto Co., Ltd.)

Hardening Agent *9:

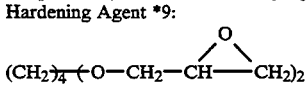

Matting Agent *10:
Benzoguanamine Resin
(the ratio of particles over 10 μm is 18 vol %)

Sensitometric Method (1) The following measurement method was used to determine the difference between the maximum spectral sensitized sensitivity and the sensitivity at the wavelength of 20 nm wavelength longer than that.

Each light-sensitive material was exposed for 5 seconds with series monochromatic light. To the layer surface of the light-sensitive material was applied water at 14 ml/m$^2$, the light-sensitive material was superposed on the dye-fixing material such that the layer surfaces were brought into contact with each other, and after heating them to 93° C. for 25 seconds, they were separated from each other. Then, using the yellow images obtained on the light-sensitive material, the relative sensitivity (sensitivity difference, logE) at the wavelength of 20 nm wavelength longer than the wavelength giving the maximum value of sensitivity to the maximum value of sensitivity was determined.

(2) Measurement of Color Separation Degree:

Each light-sensitive material was exposed under the conditions shown in Table 1 using the exposure device described in JP-A-2-129625. The light-sensitive material was treated as above. Then, the difference ($\Delta S = \log E_y - \log E_c$) between the exposure amount ($\log E_y$) giving the density of fog of yellow obtained on the dye-fixing material plus 0.1 and the exposure amount ($\log E_c$) giving the density of Dmax of cyan−0.1 was determined.

The results are shown in Table 2. The larger the value of S, the better the color separation.

TABLE 1

| Conditions for Laser Exposure | |
|---|---|
| Beam Strength | Maximum 930 μW (86 erg/cm$^2$) |
| Density of Scanning Line | 800 dpi (32 raster/mm) |
| Beam Diameter | Main Scanning Direction: 100 ± 10 μm<br>Subscanning Direction: 80 ± 10 μm |
| Exposure Duration | 5–180 nsec/pixel |
| Exposure Wavelength | 810 nm (laser light) |
| Exposure | 1 logE change per 2.5 cm in subscanning direction |
| Exposure Changing Method | Emission Time Modulation |

TABLE 2

| Light-Sensitive Material | Wavelength Giving the Maximum Sensitivity (yellow) (nm) | Difference (logE) between the Maximum Sensitivity and the Sensitivity of the Wavelength of 20/nm Longer than Maximum Sensitivity | Color Separation Degree (ΔS) |
|---|---|---|---|
| 100 | 785 | 0.5 | 0 |
| 101 | 780 | 1.4 | 1.4 |
| 102 | 785 | 1.7 | 1.5 |

From the results shown in Table 2, it can be seen that in Samples 101 and 102 of the present invention, wherein in the yellow layer, the spectral sensitivity to light of a wavelength of 20 nm longer than the wavelength at which the spectral sensitivity was maximum is less than 1/10 of the maximum value of the spectral sensitivity, the color separation of the yellow layer and the cyan layer which was spectrally sensitized at a longer wavelength than the yellow layer was greatly improved.

EXAMPLE 2

By following the same method as in Example 1, silver halide emulsions (I), (II), and (III) were prepared.

An organic silver salt was prepared as follows:

Organic Silver Salt (3):

A benzotriazole silver emulsion was prepared as follows.

In 3,000 ml of water was dissolved 28 g of gelatin and 13.2 g of benzotriazole and the solution was stirred at 40° C. To the solution was added a solution of 17 g of silver nitrate dissolved in 100 ml of water over a period of 4 minutes. Also, 90 seconds after the beginning of the addition of the aqueous silver nitrate solution, 100 ml of an aqueous 1N NaOH was added thereto over a period 3 minutes. The pH of the reaction system was kept at at least 2.

The pH of the benzotriazole silver emulsion was controlled to precipitate excess salts, which were removed. Then, the pH of the residue was adjusted to 6.50 to provide 400 g of a dispersion of benzotriazole silver.

Organic Silver Salt (4):

In a mixture of 540 ml of ethanol and 1,600 ml of water were dissolved 12.8 g of potassium 4-acetylaminophenylpropiolate and 136 ml of an aqueous solution of 10% surface active agent (O) followed by mixing and the mixture was stirred at 40° C.

To the solution was added a solution of 8 g of silver nitrate dissolved in 120 ml of water over a period of 3 minutes. After adding water to the dispersion, the dispersion was subjected to an ultrafiltrating purification such that the desalting efficiency became about 1/11 to provide 500 g of an aqueous dispersion. Furthermore, 14 g of gelatin and 96 ml of water were added to the dispersion and the mixture was dispersed by stirring at a high speed to provide 610 g of a dispersion of organic silver salt (4).

Surface Active Agent (O):

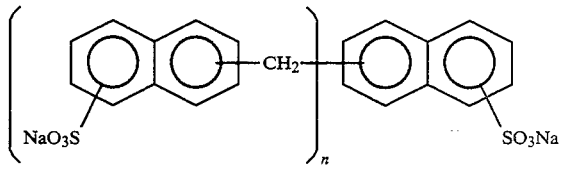

n = 4~5

Then, a gelatin dispersion of a dye-providing material was prepared in the same manner as in Example 1.

By using the above described materials, heat-developable light-sensitive material 200 shown below was prepared.

| Heat-Developable Light-Sensitive Material 200 | Amount (g/m$^2$) |
|---|---|
| Sixth Layer: Protective Layer | |
| Gelatin | 0.72 |
| Matting Agent (colloidal silica) | 0.023 |
| Water-Soluble Polymer (1) | 0.18 |
| Surface Active Agent (1) | 0.051 |
| Surface Active Agent (2) | 0.090 |
| Surface Active Agent (3) | 0.029 |
| Hardening Agent (H) | 0.035 |
| Fifth Layer: Second Infrared-Sensitive Layer | |
| Emulsion (I) | 0.27 as Ag |
| Benzotriazole | $1.9 \times 10^{-3}$ |
| Sensitizing Dye (Z) | $7.7 \times 10^{-3}$ |
| Acetylene Compound | 0.019 |
| Yellow Dye-Providing Material (A) | 0.29 |
| High Boiling Organic Solvent (1) | 0.15 |
| Reducing Agent (R) | 0.023 |
| Mercapto Compound (1) | $5.8 \times 10^{-3}$ |
| Surface Active Agent (4) | 0.032 |
| Gelatin | 0.42 |
| Water-Soluble Polymer (2) | 0.016 |
| Fourth Layer: Interlayer | |
| Gelatin | 0.56 |
| $Zn(OH)_2$ | 0.24 |
| Benzotriazole | $3.4 \times 10^{-3}$ |
| Surface Active Agent (1) | $8.8 \times 10^{-3}$ |
| Surface Active Agent (5) | $4.6 \times 10^{-3}$ |
| Water-Soluble Polymer (2) | 0.010 |
| Third Layer: Red-Sensitive Layer | |
| Emulsion (II) | 0.1 as Ag |
| Organic Silver Salt (1) | $3.8 \times 10^{-3}$ as Ag |
| Organic Silver Salt (2) | 0.016 as Ag |
| Acetylene Compound | 0.011 |
| Magenta Dye-Providing Material (B) | 0.24 |
| High Boiling Organic Solvent (2) | 0.08 |
| Reducing Agent (R) | $9.5 \times 10^{-3}$ |
| Mercapto Compound (1) | $2.4 \times 10^{-3}$ |
| Surface Active Agent (5) | 0.023 |
| Gelatin | 0.31 |
| Water-Soluble Polymer (2) | $7.4 \times 10^{-3}$ |
| Surface Active Agent (4) | 0.026 |
| Second Layer: Interlayer | |
| Gelatin | 0.62 |

-continued

| Heat-Developable Light-Sensitive Material 200 | Amount ($g/m^2$) |
|---|---|
| $Zn(OH)_2$ | 0.19 |
| Surface Active Agent (1) | $5.9 \times 10^{-3}$ |
| Surface Active Agent (5) | $3.2 \times 10^{-3}$ |
| Surface Active Agent (6) | 0.056 |
| Water-Soluble Polymer (2) | $4.5 \times 10^{-3}$ |
| First Layer: First Infrared-Sensitive Layer | |
| Emulsion (III) | 0.20 as Ag |
| Organic Silver Salt (1) | 0.032 as Ag |
| Organic Silver Salt (2) | 0.016 as Ag |
| Mercapto Compound (1) | $5.8 \times 10^{-4}$ |
| Sensitizing Dye (Y) | $2.5 \times 10^{-5}$ |
| Cyan Dye-Providing Material (C) | 0.26 |
| High Boiling Organic Solvent (1) | 0.14 |
| Reducing Agent (R) | 0.014 |
| Mercapto Compound (2) | 0.011 |
| Surface Active Agent (4) | 0.029 |
| Surface Active Agent (5) | $8.1 \times 10^{-3}$ |
| Gelatin | 0.28 |
| Water-Soluble Polymer (2) | 0.014 |
| Support: | |
| Polyethylene Terephthalate Film of 100 μm in Thickness | |
| Back Layer: | |
| Carbon Black | 0.44 |
| Polyvinyl Chloride | 0.30 |

Sensitizing Dye (Z):

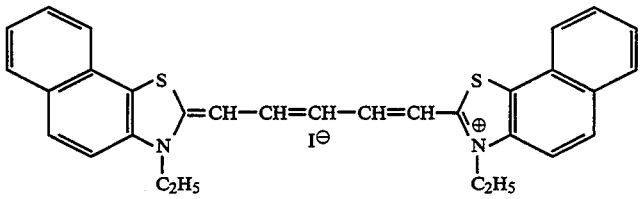

Acetylene Compound:

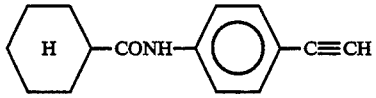

Then, by following the same procedure for preparing heat-developable light-sensitive material 200 except that each of the sensitizing dyes B-10, B-27 and B-28 of the present invention was used in the coating amount shown in the following Table in place of the sensitizing dye (2) in the first layer of light-sensitive material 100, such that the sensitivity became the same as that of the light-sensitive material 200, each of heat-developable light-sensitive materials 201, 202, and 203 was prepared.

| Sensitizing Dye | Coating Amount ($g/m^2$) |
|---|---|
| B-10 | $6.2 \times 10^{-5}$ |
| B-27 | $6.2 \times 10^{-5}$ |
| B-28 | $7.7 \times 10^{-5}$ |

Then, by the following exposure and treatment, (1) the sensitivity difference and (2) color separation were evaluated.

(1) Evaluation of Sensitivity Difference:

Each sample was exposed with a series of monochromatic light for 5 seconds, and after applying 11 $ml/m^2$ of water, the sample was heat developed at 93° C. for 25 seconds. Then, the sensitivity difference between the maximum sensitivity at a wavelength longer than 790 nm and the sensitivity at a wavelength of 60 nm to the short wave side from the wavelength giving the maximum sensitivity was measured. The results are shown in Table 4.

(2) Evaluation of Color Separation:

Each sample was exposed using the exposure device described in JP-A-2-129625 under the conditions shown in Table 3. Thereafter, 11 $ml/m^2$ of water was applied to each sample and after superposing the sample on the dye-fixing material as in Example 1, the heat development was carried out at 93° C. for 25 seconds. Then, the difference $\Delta S = \log E_y - \log E_c$ between the exposure amount $\log E_y$ giving the density of(Dmax−0.1) of yellow colored at 750 nm and the exposure amount $\log E_c$ giving the density of (Dmin+0.1) of cyan mixed colored in yellow was measured. The results are shown in Table 4. The lower the value of ΔS, the better the color separation.

TABLE 3

| | |
|---|---|
| Beam Strength on Light-Sensitive Material | 1 mW |
| Density of Scanning Line | 800 dpi (32 raster/mm) |
| Beam Diameter | Main Scanning Direction: 100 ± 10 μm<br>Subscanning Direction: 80 ± 10 μm |
| Exposure Duration | 0.9 msec/raster |
| Exposure Wavelength | 750 nm (laser light) |
| Exposure | 1 logE change per 2.5 cm in subscanning direction |
| Exposure Changing Method | Emission Time Modulation |

TABLE 4

| | Heat-Developable Light-Sensitive Material | | | |
|---|---|---|---|---|
| | 200 (Comparison) | 201 (Invention) | 202 (Invention) | 203 (Invention) |
| Maximum Sensitivity Providing Wavelength | 815 | 830 | 825 | 820 |
| Sensitivity Difference | 0.59 | 0.80 | 0.78 | 0.73 |
| Color Separation ΔS | 0.45 | −0.10 | −0.05 | −0.02 |

From the results shown in Table 4, it can be seen that by using the light-sensitive layer having the spectral sensitivity in the present invention, a heat-developable light-sensitive material provided images having excellent color separation by the exposure of light including the near infrared to infrared region.

While the invention has been described in detail and with reference to specific embodiments thereof, it will be apparent to one skilled in the art that various changes and modifications can be made therein without departing from the spirit and scope thereof.

What is claimed is:

1. A heat-developable color light-sensitive material comprising a support having thereon at least three silver halide emulsion layers each sensitive to a different spectral wavelength region, one silver halide emulsion layer or a light-insensitive layer adjacent thereto containing a yellow dye-providing compound, a second silver halide emulsion layer or a light-insensitive layer adjacent thereto containing a magenta dye-providing compound and a third silver halide emulsion layer or a light-insensitive layer adjacent thereto containing a cyan dye-providing compound; at least one of said silver halide emulsion layers having a maximum spectral sensitivity at a wavelength of at least 700 nm and a spectral sensitivity at a wavelength of 20 nm longer than said maximum spectral sensitivity wavelength of at most 1/10 of said maximum spectral sensitivity, wherein said silver halide emulsion layer having a maximum spectral sensitivity at a wavelength of at least 700 nm is spectrally sensitized with at least one sensitizing dye represented by formula (I):

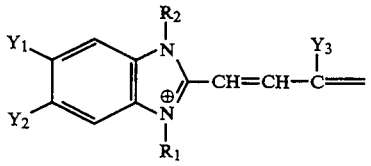

(I)

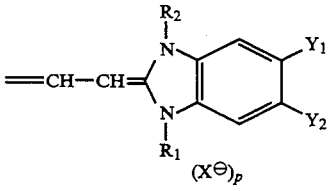

wherein $R_1$ represents an unsubstituted alkyl group having from 1 to 4 carbon atoms or an alkyl group having from 1 to 4 carbon atoms substituted with a sulfonic acid group or a sulfonic acid salt; $R_2$ represents an unsubstituted alkyl group having from 1 to 4 carbon atoms, or an alkyl group having from 1 to 4 carbon atoms substituted by a halogen or an alkoxy group having from 1 to 4 carbon atoms; $Y_1$ and $Y_2$ each represents hydrogen, chlorine, a cyano group or a trifluoromethyl group; $Y_3$ represents hydrogen, methyl, ethyl or butyl; X represents a halide ion, a sulfonate ion, or a carbonate ion; and p is 1; provided that X may be linked with $R_1$ or $R_2$ to form an intramolecular salt.

2. The heat-developable color light-sensitive material as claimed in claim 1, wherein $Y_1$ represents chlorine; $Y_2$ represents chlorine, a cyano group or a trifluoromethyl group; $Y_3$ represents hydrogen; and X represents a p-toluenesulfonate ion, an acetate ion or a sulfonate ion substituted on $R_1$ or iodide.

3. The heat-developable color light-sensitive material as claimed in claim 1, wherein at least one of said silver halide emulsion layers further comprises an organic silver salt in an amount from 0.01 to 10 mols per mol of said light-sensitive silver halide, the coating amount of said light-sensitive silver halide and said organic silver salt in said emulsion layer being from 50 mg/m$^2$ to 10 g/m$^2$.

4. The heat-developable color light-sensitive material as claimed in claim 3, wherein said at least one silver halide emulsion layer further comprises from 0.01 to 10 mols of a reducing agent per mol of silver.

5. The heat-developable color light-sensitive material as claimed in claim 4, wherein said reducing agent is a DRR compound capable of reducing said silver halide or said organic silver salt to release a diffusible dye.

6. A heat-developable color light-sensitive material comprising a support having thereon at least three silver halide emulsion layers each sensitive to a different spectral wavelength region, one silver halide emulsion layer or a light-insensitive layer adjacent thereto containing a yellow dye-providing compound, a second silver halide emulsion layer or a light-insensitive layer adjacent thereto containing a magenta dye-providing compound, and a third silver halide emulsion layer or a light-insensitive layer adjacent thereto containing a cyan dye-providing compound; at least one of said silver halide emulsion layers having a maximum spectral sensitivity at a wavelength of at least 790 nm and a sensitivity difference of at least 0.6 logE between said maximum spectral sensitivity and the spectral sensitivity of said emulsion at a wavelength 60 nm shorter than said maximum spectral sensitivity wavelength, wherein said silver halide emulsion layer having a maximum spectral sensitivity at a wavelength of at least 790 nm is sensitized with a spectral sensitizing dye represented by formula (II).

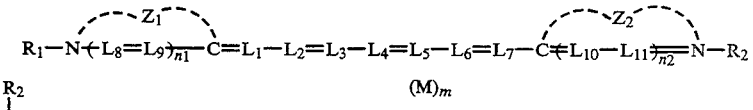

(II)

$(M)_m$ wherein $Z_1$ and $Z_2$ each represents an atomic group necessary for forming a 5-membered or 6-membered nitrogen-containing heterocyclic ring; $L_1$, $L_2$, $L_3$, $L_4$, $L_5$, $L_6$, $L_7$, $L_8$, $L_9$, $L_{10}$, and $L_{11}$ each represents a methine group; either of $L_2$ and $L_4$ or $L_3$ and $L_5$ link to form a 5-membered or 6-membered ring containing at least one oxygen or nitrogen; $n_1$ and $n_2$ each is 0 or 1; M represents a counter ion; m is the number of M counter ions necessary for charge balance; $R_1$ and $R_2$ each represents an unsubstituted alkyl group, a carboxylalkyl group, a sulfoalkyl group, an aryloxy-substituted alkyl group, or a sulfido-substituted alkyl group, with at least one of $R_1$ and $R_2$ being an aryloxy-substituted alkyl group; and said 5-membered or 6-membered nitrogen-containing heterocyclic ring formed by $Z_1$ and $Z_2$ is selected from the group consisting of naphthothiazole, benzoxazole, naphthoxazole, benzimidazole and benzothiazole.

7. The heat-developable color light-sensitive material as claimed in claim 6, wherein said sensitivity difference between said maximum sensitivity and said sensitivity of said emulsion at a wavelength 60 nm shorter than said maximum sensitivity wavelength is at least 0.7 logE.

8. The heat-developable color light-sensitive material as claimed in claim 6, wherein said 5-membered or 6-membered ring formed by $L_2$ and $L_4$ or by $L_3$ and $L_5$ is selected from

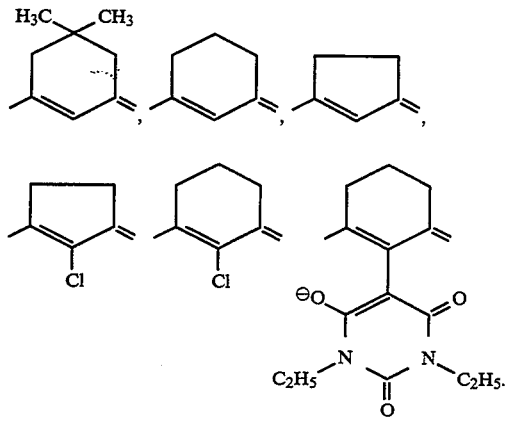

9. The heat-developable color light-sensitive material as claimed in claim 6, wherein said 5-membered or 6-membered nitrogen-containing heterocyclic ring formed by $Z_1$ and $Z_2$ is a benzothiazole ring.

10. The heat-developable color light-sensitive material as claimed in claim 6, wherein at least one layer of said silver halide emulsion layers having a maximum spectral sensitivity at a wavelength of at least 790 nm or at least one of light-insensitive layers disposed above at least one of said silver halide emulsion layers having said maximum spectral sensitivity and close to a light source comprises a dye which does not spectrally sensitize a silver halide but absorbs light of a wavelength more than 60 nm shorter than said maximum spectral sensitivity wavelength of at least 790 nm.

11. The heat-developable color light-sensitive material as claimed in claim 6, wherein at least one of said silver halide emulsion layers further comprises an organic silver salt in an amount from 0.01 to 10 mols per mol of said light-sensitive silver halide, the coating amount of said light-sensitive silver halide and said organic silver salt in said emulsion layer being from 50 $mg/m^2$ to 10 $g/m^2$.

12. The heat-developable color light-sensitive material as claimed in claim 11, wherein said at least one silver halide emulsion layer further comprises from 0.01 to 10 mols of a reducing agent per mol of silver.

13. The heat-developable color light-sensitive material as claimed in claim 12, wherein said reducing agent is a DRR compound capable of reducing said silver halide or said organic silver salt to release a diffusible dye.

* * * * *